US011156933B2

(12) United States Patent
Asano et al.

(10) Patent No.: US 11,156,933 B2
(45) Date of Patent: Oct. 26, 2021

(54) IMAGE FORMING METHOD

(71) Applicant: Konica Minolta, Inc., Tokyo (JP)

(72) Inventors: Keisuke Asano, Hachioji (JP); Shiro Hirano, Hachioji (JP); Kazuhiko Nakajima, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/854,650

(22) Filed: Apr. 21, 2020

(65) Prior Publication Data

US 2020/0356020 A1 Nov. 12, 2020

(30) Foreign Application Priority Data

May 9, 2019 (JP) ..... JP2019-089287

(51) Int. Cl.
*G03G 9/08* (2006.01)
*G03G 9/087* (2006.01)
*G03G 9/107* (2006.01)

(52) U.S. Cl.
CPC ..... *G03G 9/08782* (2013.01); *G03G 9/0806* (2013.01); *G03G 9/08755* (2013.01); *G03G 9/08795* (2013.01); *G03G 9/08797* (2013.01); *G03G 9/1075* (2013.01)

(58) Field of Classification Search
CPC ..... G03G 9/08782
USPC ..... 430/108.8
See application file for complete search history.

(56) References Cited

U.S. PATENT DOCUMENTS

2015/0227073 A1 8/2015 Imamoto et al.
2018/0173128 A1* 6/2018 Moffat ..... G03G 9/0804

FOREIGN PATENT DOCUMENTS

JP 2014-112205 A 6/2014
JP 2016-031417 A 3/2016

* cited by examiner

*Primary Examiner* — Mark A Chapman
(74) *Attorney, Agent, or Firm* — Lucas & Mercanti, LLP

(57) ABSTRACT

Provided is an image forming method, including: transferring and fixing a toner onto a recording medium, and forming an image including a plurality of layers, in which an attachment amount of the toner on the recording medium is greater than or equal to 8 g/m$^2$ and less than or equal to 40 g/m$^2$, a toner forming a layer in contact with a fixing member contains at least a first mold release agent containing ester wax and a second mold release agent containing microcrystalline wax, and a special color toner is contained in any layer of the plurality of layers.

7 Claims, 1 Drawing Sheet

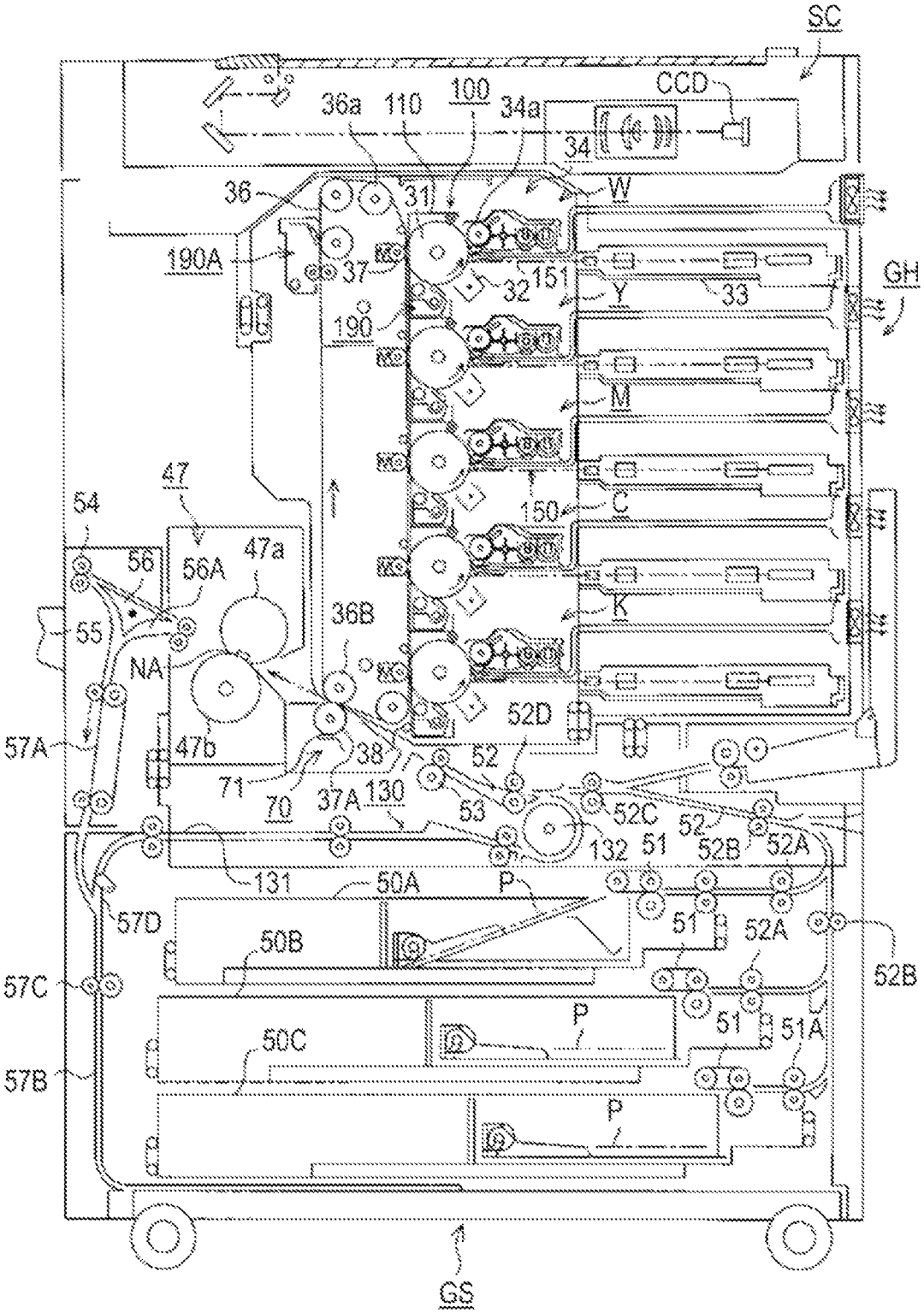
SC
CCD
36a
110
100
34a
34
36
31
W
190A
37
32
151
Y
33
GH
190
M
47
54
56
56A
47a
150
C
55
36B
K
NA
52D
57A
47b
38
52
71
70
37A
130
53
52C
52
132
51
52B
52A
131
50A
P
57D
50B
51
52A
52B
57C
P
51
51A
50C
57B
P
GS

IMAGE FORMING METHOD

CROSS-REFERENCE TO RELATED APPLICATION

The entire disclosure of Japanese Patent Application No. 2019-089287, filed on May 9, 2019, is incorporated herein by reference in its entirety.

BACKGROUND

1. Technical Field

The present invention relates to an image forming method.

2. Description of Related Arts

In an image forming method using an electrophotographic method, an electrostatic latent image is formed by being evenly charged on an image forming body with a charging unit, and then, by being subjected to image exposure. A latent image portion is consecutively developed by a developing unit, and thus, a toner image is formed.

Recently, in the field of a toner for developing an electrostatic latent image that is used for forming an electrophotographic image, development according to various demands from the marker has been conducted. In particular, the number of types of recording medium to be printed has increased, and a demand from the market for adaptability of a printing machine with respect to the recording medium is extremely high.

For example, in the case of performing output with respect to a special recording medium such as colored paper or black paper, aluminized paper or a transparent film, sufficient color development is not capable of being obtained only by a full color toner such as a yellow (Y) toner, a magenta (M) toner, a cyan (C) toner, and a black (K) toner, due to the influence of color properties of the recording medium. Therefore, in order to improve an added value of an image, various special color toners that are formed on a lower layer or an upper layer of an image formed by a combination of the color toners have been developed, and a market demand for such a high-value added image has increased every year.

There are diverse toners such as a white toner, a transparent toner, a silver-colored toner using a silver foil as a coloring agent, a gold-colored toner using a gold foil as a coloring agent, and a fluorescent toner, as the special color toner for forming a high-value added image.

When such special color toners are used, there is also a method of using special color toners in a general four-barrel machine by adding one barrel to be five barrels or by adding two barrels to be six barrels. In such a method, it is necessary to transfer and fix all colors of an image that includes a plurality of layers and has a large attachment amount of a toner with respect to a medium such as paper, simultaneously, at the time of secondary transfer.

In general, when high-value added printing using a special color toner is performed, it is necessary to superimpose a layer formed of a toner containing a pigment of high specific gravity, such as alumina or titanium oxide, as a coloring agent, a plurality of times. For this reason, an attachment amount of toners tends to remarkably increase, compared to full-color toner printing of four colors of YMCK of the related art. The attachment amount of the toner is large, and thus, a toner more excellent in fixing properties than that in a printing method of the related art is required.

Until now, there has been a method for fixing an image having a large attachment amount of a toner by increasing a temperature of a fixing roller or increasing a transit time of a fixing nip such that strong thermal energy is applied, compared to the related art, at the time of fixing. However, in such a fixing method, there has been a new problem in that a cohesive force in a toner layer is weakened, and a separation failure of an image from a fixing member easily occurs.

In Japanese Patent Application Laid-Open No. 2016-31417 or Japanese Patent Application Laid-Open No. 2014-112205 (corresponding to Specification of U.S. Patent Application Publication No. 2015/227073), a means for improving low-temperature fixing properties of an image having a high attachment amount is disclosed.

In addition, in high-value added printing, there also has been a new problem in that fusion and compatibleness occur between a toner on the uppermost layer in contact with a fixing member and a layer adjacent thereto due to excessive thermal energy, a color of a layer that is not the uppermost layer is oozed out to the surface, an image concentration of the upper layer decreases, and thus, color turbidity occurs, along with the problem of the separation failure. As a means for solving such problems, in Japanese Patent Application Laid-Open No. 2016-048310, a means for controlling a solubility parameter (an SP value) of a resin configuring a toner is proposed.

SUMMARY

However, in known technologies such as Japanese Patent Application Laid-Open No. 2016-31417 or Japanese Patent Application Laid-Open No. 2014-112205 (corresponding to Specification of U.S. Patent Application Publication No. 2015/227073), the use of the special color toner is not assumed, and it is not insufficient for fixing properties and fixing separation properties to reach a level required for high-value added printing.

In addition, in the technology described in Japanese Patent Application Laid-Open No. 2016-048310, paraffin-based wax without a branch is used, and thus, the problem of the color turbidity can be solved, but there is a problem in that the fixing properties are degraded.

Therefore, an object of the present invention is to provide an image forming method in which low-temperature fixing properties and fixing separation properties when an attachment amount of a toner increases are excellent, and it is possible to prevent oozing of a layer adjacent to an upper layer in contact with a fixing member with respect to the upper layer, in high-value added printing.

The present inventors have conducted intensive studies in consideration of the problems described above. As a result thereof, it has been found that in a method for forming an image that includes a plurality of toner layers and a high attachment amount, in a case where two types of mold release agents of ester wax and microcrystalline wax are contained in a toner forming an upper layer in contact with a fixing member, the problems can be solved regardless of the type of toner in a layer below the upper layer, and the present invention has been completed.

To achieve at least one of the abovementioned objects, according to an aspect of the present invention, an image forming method is an image forming method, including: transferring and fixing a toner onto a recording medium, and forming an image including a plurality of layers, in which an attachment amount of the toner on the recording medium is greater than or equal to 8 g/m$^2$ and less than or equal to 40 g/m$^2$, a toner forming a layer in contact with a fixing member contains at least a first mold release agent composed of ester wax and a second mold release agent composed of microcrystalline wax, and a special color toner is contained in any layer of the plurality of layers.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 1 is a schematic configuration diagram illustrating an image forming apparatus according to one embodiment of the present invention. In FIG. 1, a reference numeral 31 represents a photoreceptor drum, reference numeral 32 represents a charger, a reference numeral 33 represents an exposure optical system as an image writing unit, a reference numeral 34 represents a developing device, a reference numeral 34*a* represents a developing roller, a reference numeral 36 represents an intermediate transfer body, a reference numeral 36*a* represents a tension roller, a reference numeral 36B represents a backup roller, a reference numeral 37 represents a primary transfer roller, a reference numeral 37A represents a secondary transfer member, a reference numeral 38 represents a detection sensor, a reference numeral 47 represents a fixing device, a reference numeral 47*a* represents a heating roller, a reference numeral 47*b* represents a pressure belt, reference numerals 50A, 50B, and 50C represent a paper feeding cassette, a reference numeral 51 represents a feeding roller, a reference numeral 52 represents a conveyance path, a reference numeral 52A represents a paper feeding roller, reference numerals 52B, 52C, and 52D represent a conveyance roller, a reference numeral 53 represents a resist roller, a reference numeral 54 represents a paper ejection roller, a reference numeral 55 represents a paper ejection tray, a reference numeral 70 represents a secondary transfer device, a reference numeral 100 represents a process unit of yellow (Y), magenta (M), cyan (C), black (K), and white (W), a reference numeral 190 represents a photoreceptor cleaning device as an image carrier cleaning unit, a reference numeral 190A represents an intermediate transfer body cleaning device, a reference numeral GS represents an image forming apparatus, a reference numeral SC represents an image reading device, a reference numeral CCD represents a line image sensor, and a reference numeral P represents a recording medium.

DETAILED DESCRIPTION

Hereinafter, one or more embodiments of the present invention will be described with reference to the drawings. However, the scope of the invention is not limited to the disclosed embodiments. In the description of the drawings, the same elements are denoted by the same reference numerals, and redundant description is omitted. In addition, in some cases, dimensional ratios in the drawings are exaggerated and different from actual ratios for convenience of the description.

Herein, unless otherwise specified, an operation and a measurement of physical properties or the like are performed at room temperature (higher than or equal to 20° C. and lower than or equal to 25° C.)/relative humidity of greater than or equal to 40% RH and less than or equal to 50% RH.

An image forming method according to one embodiment of the present invention is an image forming method, including: transferring and fixing a toner onto a recording medium, and forming an image including a plurality of layers, in which an attachment amount of the toner on the recording medium is greater than or equal to 8 g/m$^2$ and less than or equal to 40 g/m$^2$, a toner forming a layer in contact with a fixing member contains at least a first mold release agent composed of ester wax and a second mold release agent composed of microcrystalline wax, and a special color toner is contained in any layer of the plurality of layers.

According to the image forming method of this embodiment, fixing properties and fixing separation properties at a low temperature when an attachment amount of a toner increases are excellent, and it is possible to prevent an upper layer from being oozed out to a layer adjacent to the upper layer, to prevent a decrease in the concentration of an upper layer image, and to prevent color turbidity, in high-value added printing.

The reason that the effects described above can be obtained by the image forming method of the configuration described above is not clear, but the following mechanism is considered. Note that, the following mechanism is considered by presumption, and the present invention is not limited to the following mechanism.

First, the toner forming the upper layer in contact with the fixing member contains the ester wax, and thus, a mutual interaction between a binding resin that is a main binder and the ester wax increases through an ester group. For this reason, compatibility between the binding resin and the ester wax increases, and in the high-value added printing, even in a case where an attachment amount of a toner increases, high low-temperature fixing properties can be obtained. Further, in a case where the toner forming the upper layer in contact with the fixing member contains the microcrystalline wax that is hydrocarbon-based wax, compatibility between microcrystalline and the binding resin decreases. However, the microcrystalline wax has a branched structure, and has a low melting point, compared to paraffin wax having a linear structure, and thus, in the high-value added printing, even in a case where the attachment amount of the toner increases, it is possible to ensure the low-temperature fixing properties.

As described above, the microcrystalline wax contained in the toner forming the upper layer in contact with the fixing member has low compatibility with respect to the binding resin. In the high-value added printing, in a case where the attachment amount of the toner increases, more thermal energy is applied at the time of fixing. In a case where the thermal energy at the time of fixing increases, and thus, the microcrystalline wax is melted and is in a liquid state, the microcrystalline wax is moved to a surface of the toner forming the upper layer without being compatible with the binding resin. Accordingly, an attachment force between the fixing member and the upper layer considerably decreases, and thus, an effect such as high separation properties between the recording medium and the fixing member can be obtained.

Further, the microcrystalline wax contained in the toner forming the upper layer in contact with the fixing member accelerates crystal growth from a melted state after fixing, and accelerates solidification of the toner in the upper layer. Therefore, in the high-value added printing, even in a case where an attachment amount of a toner increases, the upper layer is solidified before being compatible with the layer adjacent to the upper layer, and thus, it is possible to prevent a decrease in an image concentration of the upper layer, and to prevent the color turbidity due to the adjacent layer.

Note that, the mechanism described above is considered by presumption, and the present invention is not limited to the functional mechanism described above.

Hereinafter, the image forming method of this embodiment will be described.

FIG. 1 is a sectional schematic view illustrating an example of an image forming apparatus according to an image forming method of the present invention. In FIG. 1, an example is illustrated in which four types of toners of YMCK are used as a color toner, and a white toner (W) is used as a special color toner. However, in addition to such a white toner, one type of special color toners such as a metallic toner (ME) and a transparent toner (CL) can be independently used, or two or more types thereof can be used by being combined, in accordance with the purpose. In FIG. 1, it is illustrated as an example in which one type of special color toner is used in a general four-barrel machine (YMCK) by adding one barrel to be five barrels, but two types of special color toners may be used in the general four-barrel machine (YMCK) by adding two barrels to be six barrels, in accordance with the purpose.

First, the outline of a color electrophotographic image forming apparatus on which a detection sensor and a secondary transfer device are mounted will be described.

An image forming apparatus GS is referred to as a tandem type color image forming apparatus. In the GS, image forming units forming color toner images of each of yellow, magenta, cyan, and black, and a white toner image that is one type of special color toner are disposed along a movement direction of an intermediate transfer body 36. In the GS, the color toner images and the white toner image formed on image carriers of each of the image forming units are multi-transferred onto an intermediate transfer body, and are superimposed, and then, are collectively transferred onto an image support body.

In FIG. 1, an original image placed on an image reading device SC that is disposed in a position covering an upper portion of the image forming apparatus GS is subjected to scanning exposure by an optical system, and is read in a line image sensor CCD. An analog signal subjected to photoelectric conversion by the line image sensor CCD is subjected to analog signal processing, A/D conversion, shading compensation, image compression processing, and the like, in an image processing unit, and is sent to an exposure optical system 33 as an image writing unit, as an image data signal.

The intermediate transfer body 36 includes a drum type intermediate transfer body and an endless belt type intermediate transfer body, and both have the same function, but in the following description, the intermediate transfer body indicates the intermediate transfer body 36 in the shape of an endless belt.

In addition, in FIG. 1, five sets of process units 100 for forming images of each color of yellow (Y), magenta (M), cyan (C), black (K), and white (W) are provided in a periphery portion of the intermediate transfer body 36. The process units 100 are vertically disposed in a perpendicular direction along the intermediate transfer body 36, with respect to a rotation direction of the intermediate transfer body 36 in a vertical direction represented by an arrow in the drawing, as a forming unit of the color toner images and the white toner image, and are disposed in the order of Y, M, C, K, and W.

Five sets of process units 100 have a common structure, and each of the process units includes a photoreceptor drum 31, a charger 32 as a charging unit, an exposure optical system 33 as the image writing unit, a developing device (a developing machine) 34, and a photoreceptor cleaning device 190 as an image carrier cleaning unit.

In the photoreceptor drum 31, for example, a photosensitive layer having a layer thickness (a film thickness) of greater than or equal to 20 μm and less than or equal to 40 μm is formed on an outer circumference of a cylindrical base that is formed by a metallic member, such as aluminum, having an outer diameter of greater than or equal to 40 mm and less than or equal to 100 mm. The photoreceptor drum 31 is rotated in a direction of an arrow by power from a driving source (not illustrated), in a state where the base is grounded, for example, at a linear speed of greater than or equal to 80 mm/s and less than or equal to 280 mm/s, preferably at a linear speed of 220 mm/s.

An image forming unit including the charger 32 as the charging unit, the exposure optical system 33 as the image writing unit, and the developing device (the developing machine) 34 as one set is disposed around the photoreceptor drum 31, with respect to a rotation direction of the photoreceptor drum 31 represented by an arrow in the drawing.

The charger 32 as the charging unit is attached to face and be close to the photoreceptor drum 31 in a direction parallel to a rotation axis of the photoreceptor drum 31. The charger 32 includes a discharge wire as a corona discharge electrode that applies a predetermined potential to the photosensitive layer of the photoreceptor drum 31, performs a charging action by corona discharge having the same polarity as that of the toner (in this embodiment, negative charging), and applies an even potential to the photoreceptor drum 31.

The exposure optical system 33 that is the image writing unit performs rotation scanning of laser light emitted from a semiconductor laser (LD) light source (not illustrated) in a main scanning direction by rotary multifaceted mirror (no reference numeral), performs exposure (image writing) according to an electric signal corresponding to an image signal on the photoreceptor drum 31 through an fθ lens (no reference numeral), an reflective mirror (no reference numeral), and the like, and forms an electrostatic latent image corresponding to the original image on the photosensitive layer of the photoreceptor drum 31.

The developing device 34 as a developing unit contains a two-component developer of each color of yellow (Y), magenta (M), cyan (C), black (K), and white (W), which is charged to the same polarity as charging polarity of the photoreceptor drum 31. Further, the developing device 34, for example, includes a developing roller 34*a* that is a cylindrical developer carrier formed of a non-magnetic stainless steel or aluminum material having a thickness of greater than or equal to 0.5 mm and less than or equal to 1 mm and an outer diameter of greater than or equal to 15 mm and less than or equal to 25 mm. The developing roller 34*a* is retained in a non-contact manner by a butting roll (not illustrated) with a predetermined gap with respect to the photoreceptor drum 31, for example, a gap of greater than or equal to 100 μm and less than or equal to 1000 μm, and is rotated in the same direction as the rotation direction of the photoreceptor drum 31. For this reason, a direct voltage having the same polarity as that of the toner (in this embodiment, negative polarity) or a developing bias voltage in which an alternating voltage is superimposed on a direct voltage is applied to the developing roller 34*a* at the time of developing, and thus, reversal developing is performed with respect to an exposed portion on the photoreceptor drum 31.

A semiconductive endless (seamless) resin belt having a volume resistivity of greater than or equal to $1.0\times10^{7}$ Ω·cm and less than or equal to $1.0\times10^{9}$ Ω·cm and a surface resistivity of greater than or equal to $1.0\times10^{10}$Ω/□(square) and less than or equal to $1.0\times10^{12}$Ω/□ is used as the intermediate transfer body 36. A semiconductive resin film having a thickness of greater than or equal to 0.05 mm and less than or equal to 0.5 mm, in which a conductive material is dispersed in engineering plastic such as modified polyimide, thermosetting polyimide, an ethylene tetrafluoroethylene copolymer, polyvinylidene fluoride, and a nylon alloy, can be used as the resin belt. In addition, a semiconductive rubber belt having a thickness of greater than or equal to 0.5 mm and less than or equal to 2.0 mm, in which a conductive material is dispersed in silicone rubber, urethane rubber, or the like, can also be used as the intermediate transfer body 36. The intermediate transfer body 36 is wound by a plurality of roller members including a tension roller 36*a* and a backup roller 36B facing a secondary transfer member, and is supported to be rotatable in a vertical direction.

A primary transfer roller 37 as a first transfer unit of each color, for example, includes a roller-shaped conductive member using foamed rubber such as silicone or urethane, and is provided to face the photoreceptor drum 31 for each color by interposing the intermediate transfer body 36 therebetween. Accordingly, the primary transfer roller 37 presses a back surface of the intermediate transfer body 36, and forms a transfer area with the photoreceptor drum 31. A direct constant current having polarity opposite to that of the toner (in this embodiment, positive polarity) is applied to the primary transfer roller 37 by constant current control, and a toner image on the photoreceptor drum 31 is transferred onto the intermediate transfer body 36, in accordance with a transfer electric field that is formed in the transfer area.

The toner image transferred onto the intermediate transfer body 36 is transferred onto a recording medium P. A detection sensor 38 for measuring a concentration of a patch image toner is provided around the intermediate transfer body 36.

In a fixing device 47 fixing the transferred recording medium P, a heating roller 47*a* and a pressure belt 47*b* are provided, and thus, a nip portion is formed. Accordingly, in a plurality of toner layers transferred onto the recording medium P, a fixing member in contact with an upper layer is a heating roller 47*a*, in FIG. 1.

Note that, in order to handle a high-speed printing, a known fixing device (not illustrated) of the related art in which fixing is performed with a fixing belt may be used. In a fixing method using a such device in which fixing is performed with the fixing belt, the recording medium P carrying an unfixed toner image is sent to the fixing device, and is guided to the nip portion while being guided by a guide plate. Then, the fixing belt (a "fixing upper belt" in an example) is closely attached to the recording medium P, and thus, an unfixed toner image is rapidly fixed onto the recording medium P. In addition, the recording medium P receives an airflow from an airflow separation device, on a downstream end of the fixing nip portion. For this reason, the separation of the recording medium P from the fixing belt can be accelerated. The recording medium P separated from the fixing belt is guided to the outside of the image forming apparatus by a guide roller.

A paper ejection rollers 54 for ejecting the fixed recording medium P by interposing the recording medium therebetween, and a paper ejection tray 55 for placing the recording medium P that is ejected to the outside of the apparatus are provided on the downstream side of the fixing device 47.

On the other hand, in order to clean a residual toner on the intermediate transfer body 36, a cleaning device 190A is provided.

Further, in order to clean a patch image toner on a secondary transfer member 37A, a secondary transfer device 70 is provided.

Next, an image forming method will be described.

A photoreceptor driving motor (not illustrated) is activated in accordance with the start of image recording, and the photoreceptor drum 31 of yellow (Y) is rotated in the direction represented by the arrow in the drawing, and a potential is applied to the photoreceptor drum 31 of Y by the charger 32 of Y. Exposure (image writing) according to a first color signal, that is, an electric signal corresponding to image data of Y is performed by the exposure optical system 33 of Y, after a potential is applied to the photoreceptor drum 31 of Y, and an electrostatic latent image corresponding to an image of yellow (Y) is formed on the photoreceptor drum 31 of Y. The latent image is subjected to reversal developing by the developing device 34 of Y, and a toner image formed of a toner of yellow (Y) is formed on the photoreceptor drum 31 of Y. The toner image of Y formed on the photoreceptor drum 31 of Y is transferred onto the intermediate transfer body 36 by the primary transfer roller 7 as a primary transfer unit.

Next, a potential is applied to the photoreceptor drum 31 of M by the charger 32 of magenta (M). Exposure (image writing) according to the first color signal, that is, an electric signal corresponding to image data of M is performed by the exposure optical system 33 of M, after a potential is applied to the photoreceptor drum 31 of M, and an electrostatic latent image corresponding to an image of magenta (M) is formed on the photoreceptor drum 31 of M. The latent image is subjected to reversal developing by the developing device 34 of M, and a toner image formed of a toner of magenta (M) is formed on the photoreceptor drum 31 of M. The toner image of M formed on the photoreceptor drum 31 of M is superimposed on the toner image of Y by the primary transfer roller 37 as the primary transfer unit, and is transferred onto the intermediate transfer body 36.

According to the same process, a toner image formed of a toner of cyan (C) that is formed on the photoreceptor drum 31 of cyan (C), and a toner image formed of a toner of black (K) that is formed on the photoreceptor drum 31 of black (K) are sequentially superimposed and formed on the intermediate transfer body 36. Accordingly, a superimposed color toner image formed of the toners of Y, M, C, and K is formed on the circumferential surface of the intermediate transfer body 36.

Next, the photoreceptor drum 31 of white (W) is rotated in the direction represented by the arrow in the drawing, and a potential is applied to the photoreceptor drum 31 of W by the charger 32 of W. Exposure (image writing) according to the first color signal, that is, an electric signal corresponding to image data of W is performed by the exposure optical system 33 of W, after a potential is applied to the photoreceptor drum 31 of W, and an electrostatic latent image corresponding to an image of white (W) is formed on the photoreceptor drum 31 of W. The latent image is subjected to reversal developing by the developing device 34 of W, and a toner image formed of a toner of white (W) is formed on the photoreceptor drum 31 of W. The toner image of W formed on the photoreceptor drum 31 of W is transferred onto the intermediate transfer body 36 by the primary transfer roller 7 as the primary transfer unit. Accordingly, the superimposed color toner image formed of the toners of Y, M, C, and K is formed, and a white (specific color) toner image formed of the toner of W is formed on the color toner image, on the circumferential surface of the intermediate transfer body 36. Note that, in the example of FIG. 1, the toner image formed of the toner of white (W) is formed on a lower layer of a color image (a color toner layer) formed by combining the color toners. In the example of FIG. 1, an image is formed on a white toner layer by a color toner, and thus, is formed in the entire image forming region of the recording medium P such that the visibility of the color toner is improved, and an added value as an image can be increased. In the example of FIG. 1, it is illustrated that the white toner layer is formed in the entire image forming region of the recording medium P such that the white toner layer (a white underlayer of solid coating) is formed on the lower layer of the color image. However, in this embodiment, the special color toner such as the white toner may be contained in any layer of the plurality of toner layers, or may be contained in a layer in contact with the fixing member (the upper layer), in accordance with the purpose of use.

The toner remaining on the circumferential surface of each of the photoreceptor drums 31 after transfer is cleaned by the photoreceptor cleaning device 190.

On the other hand, the recording medium P as recording paper, which is contained in paper feeding cassettes 50A, 50B, and 50C, is fed by a feeding roller 51 and a paper feeding roller 52A that are provided in each of the paper feeding cassettes 50A, 50B, and 50C. Next, the recording medium P is conveyed on a conveyance path 52 by conveyance rollers 52B, 52C, and 52D. Further, the recording medium P is conveyed to the secondary transfer member 37A as a secondary transfer unit to which a voltage having polarity opposite to that of the toner (in this embodiment, positive polarity) is applied, through a resist roller 53. Subsequently, in a transfer area of the secondary transfer member 37A, the superimposed color toner image (the color image) formed on the intermediate transfer body 36, and the white (specific color) toner image on the color toner image (the color image) are collectively transferred onto the recording medium (the image support body) P. Accordingly, an image is formed on the white toner layer by the color toner.

The recording medium P in which the color image is transferred onto the white toner layer (the white underlayer of the solid coating) is heated, pressurized, and fixed in the nip portion formed by the heating roller 47*a* and the pressure belt 47*b* of the fixing device 47. Next, the recording medium P on which the image is fixed is interposed between the paper ejection rollers 54, and is placed on the paper ejection tray 55 outside the apparatus.

The white toner layer (the white underlayer of the solid coating) and the color image are transferred onto the recording medium P by the secondary transfer member 37A as the secondary transfer unit, and then, the residual toner on the intermediate transfer body 36 that is obtained by performing curvature separation with respect to the recording medium P is removed by the intermediate transfer body cleaning device 190A.

Further, the patch image toner on the secondary transfer member 37A is cleaned by a cleaning blade 71 of the secondary transfer device 70.

The recording medium that is used in the image forming method of this embodiment may be a recording medium that is generally used, and for example, may be a recording medium on which a toner image formed by a known image forming method of an image forming apparatus or the like is retained. Accordingly, the recording medium is not particularly limited. Examples of the recording medium that can be used include plain paper from thin paper to thick paper, high-quality paper, art paper, coated printing paper such as coated paper, commercially available Japanese paper, postcard paper, a plastic film for OHP, cloth, soft transparent film, synthetic paper such as Yupo paper, and the like. In the image forming method of this embodiment, in particular, in the case of performing output with respect to a special recording medium such as colored paper or black paper, and aluminized paper or a transparent film, an excellent effect can be attained. Specifically, in the case of performing output with respect to the special recording medium, in the high-value added printing, a special color toner layer is formed on an upper layer or a lower layer of a full color image, and low-temperature fixing properties and fixing separation properties when an attachment amount increases are excellent. Further, it is possible to prevent the toner from being oozed out to a layer adjacent to the upper layer, and to prevent a decrease in an image concentration of an upper layer image. For this reason, visibility of a color toner can be improved, color reproducibility of a color image is excellent, a high-definition image without color blur and image peeling can be formed, and an added value as an image can be increased.

As described above, the image forming method of this embodiment includes transferring and fixing the toner onto the recording medium, and forming the image including the plurality of toner layers. That is, the image forming method of this embodiment includes performing high-value added printing including the plurality of toner layers. Accordingly, it is possible to form a high-value added image of which a unit value per one sheet is increased.

Further, in the image forming method of this embodiment, the attachment amount of the toner on the recording medium is greater than or equal to 8 $g/m^2$ and less than or equal to 40 $g/m^2$. This is because the attachment amount of the toner on the recording medium increases by performing the high-value added printing. In order to fix a toner having such a high attachment amount, the required thermal energy also increases. For this reason, in a case where the attachment amount of the toner is less than 8 $g/m^2$, excessive thermal energy is easily applied to a toner having a small attachment amount at the time of fixing, and thus, the color turbidity easily occurs. On the other hand, in a case where the attachment amount of the toner is greater than 40 $g/m^2$, the attachment amount of the toner is excessively large, and thus, it is difficult to conduct heat to the toner layer of the lower layer, and a fixing failure easily occurs. From such a viewpoint, the attachment amount of the toner on the recording medium is preferably greater than or equal to 15 $g/m^2$ and less than or equal to 35 $g/m^2$, and is more preferably greater than or equal to 20 $g/m^2$ and less than or equal to 30 $g/m^2$.

In addition, in the image forming method of this embodiment, the toner forming the upper layer in contact with the fixing member contains, at least the first mold release agent composed of the ester wax and the second mold release agent composed of the microcrystalline wax. The toner forming the upper layer contains such two types of waxes, and thus, the effects of the present invention can be obtained by the mechanism described above.

Further, in the image forming method of this embodiment, the special color toner is contained in any of the toner layers. By using the special color toner for forming a high-value added image, it is possible to form a high-value added image according to the type of recording medium to be printed, such as colored paper or black paper, and aluminized paper or a transparent film, in addition to paper. Further, the value of a product can be increased by freely changing a layer using the special color toner, in accordance with a product concept or a user demand.

In the toner forming the upper layer in contact with the fixing member, it is preferable that a total content of the first mold release agent and the second mold release agent is greater than or equal to 5 mass % and less than or equal to 30 mass %, in the toner. In a case where the total content of the first mold release agent and the second mold release agent is greater than or equal to 5 mass %, a mold release agent component does not excessively decrease, a decrease in the image concentration can be excellently prevented, and the fixing separation properties can be further improved. In a case where the total content of the first mold release agent and the second mold release agent is less than or equal to 30 mass %, a large amount of heat is not required to melt the mold release agent at the time of fixing, and thus, the low-temperature fixing properties can be further improved. From such a viewpoint, the total content of the first mold release agent and the second mold release agent is more preferably greater than or equal to 10 mass % and less than or equal to 25 mass %, and is even more preferably greater than or equal to 13 mass % and less than or equal to 17 mass %, in the toner.

In the toner forming the upper layer in contact with the fixing member, it is preferable that a content of the microcrystalline wax is greater than or equal to 2 mass % and less than or equal to 30 mass %, in the mold release agent. In a case where the content of the microcrystalline wax is greater than or equal to 2 mass %, crystallization in the image after fixing is easily accelerated, and thus, it is possible to further prevent the color turbidity. In addition, a melting point of the microcrystalline wax is higher than that of the ester wax, and in a case where the content of the microcrystalline wax in the mold release agent increases, a melting point of the entire mold release agent also increases. In a case where the content of the microcrystalline wax is less than or equal to 30 mass %, it is difficult to increase the melting point of the entire mold release agent, and thus, the low-temperature fixing properties can be further improved. From such a viewpoint, the content of the microcrystalline wax is more preferably greater than or equal to 5 mass % and less than or equal to 20 mass %, and is even more preferably greater than or equal to 8 mass % and less than or equal to 12 mass %, in the mold release agent.

In the toner forming the upper layer in contact with the fixing member, it is preferable that a peak top temperature (also referred to as a crystallization temperature) at a temperature decrease, as measured by a differential scanning calorimeter (DSC), is higher than or equal to 55° C. and lower than or equal to 80° C. In a case where the crystallization temperature is higher than or equal to 55° C., the crystallization in the image after fixing easily occurs, and thus, it is possible to further prevent the color turbidity. In a case where the crystallization temperature is lower than or equal to 80° C., the low-temperature fixing properties can be further improved. From such a viewpoint, the crystallization temperature is more preferably higher than or equal to 58° C. and lower than or equal to 73° C., and is even more preferably higher than or equal to 60° C. and lower than or equal to 68° C. In order to control the crystallization temperature of the toner, for example, a method of blending an amorphous resin (an amorphous polyester resin or the like) or crystalline resin (a crystalline polyester resin or the like), having a melting point or a glass transition temperature close to the range of the crystallization temperature described above, in a predetermined content range, or the like may be exemplified. However, the method is not limited thereto.

In an endothermic curve that is obtained by the measurement of the differential scanning calorimeter, the crystallization temperature of the toner forming the upper layer indicates a temperature of a peak of which a half-value width of an endothermic peak is within 15° C. at the time of being measured at a temperature decrease rate of 10° C./min at the temperature decrease. The endothermic curve, for example, can be measured by using a differential scanning calorimeter "Diamond DSC" (manufactured by PerkinElmer Co., Ltd.).

The attachment amount of the toner forming the upper layer in contact with the fixing member is preferably greater than or equal to 5 mass % and less than or equal to 90 mass %, is more preferably greater than or equal to 8 mass % and less than or equal to 90 mass %, and is even more preferably greater than or equal to 10 mass % and less than or equal to 90 mass %, with respect to a total attachment amount of the toner on the recording medium. In a case where the attachment amount of the toner forming the upper layer is preferably greater than or equal to 5 mass %, is more preferably greater than or equal to 8 mass %, and is even more preferably greater than or equal to 10 mass %, with respect to the total attachment amount, most of the configuration of the plurality of toner layers is not occupied by a toner layer not having a configuration in which both of the ester wax and the microcrystalline wax are contained. For this reason, it is advantageous in that the low-temperature fixing properties and the fixing separation properties are more excellent, and the color turbidity is less likely to occur. In a case where the attachment amount of the toner forming the upper layer is preferably less than or equal to 90 mass %, is more preferably less than or equal to 50 mass %, and is even more preferably less than or equal to 30 mass %, with respect to the total attachment amount, a toner containing paraffin-based wax of which the melting point easily increases is not contained in all of the toner layers. For this reason, the low-temperature fixing properties can be further improved. From such a viewpoint, the attachment amount of the toner forming the upper layer is more preferably greater than or equal to 5 mass % and less than or equal to 50 mass %, and is even more preferably greater than or equal to 8 mass % and less than or equal to 30 mass %, with respect to the total attachment amount of the toner.

It is preferable that the special color toner forming any toner layer contains titanium oxide as a white coloring agent in an content of greater than or equal to 2 mass % and less than or equal to 50 mass %, in the toner. In a case where the content of titanium oxide that is the white coloring agent is greater than or equal to 2 mass %, it is possible to form a high-value added image with sufficient color development. It is advantageous that the content of titanium oxide that is the white coloring agent is less than or equal to 50 mass %, since the toner is not cured by a filler effect of fine particles, and thus, it is possible to prevent a decrease in the fixing properties. From such a viewpoint, it is more preferable that the special color toner contains titanium oxide in a content of greater than or equal to 5 mass % and less than or equal to 50 mass %, and it is even more preferable that the special color toner contains titanium oxide in a content of greater than or equal to 10 mass % and less than or equal to 35 mass %.

(Toner)

Next, the toner will be described. The toner used in this embodiment contains a binding resin and a mold release agent, as toner base particles. In addition, the special color toner other than a transparent toner and the color toner further contain a coloring agent, as the toner base particles. Toner particles indicate particles obtained by adding an external additive to the toner base particles, and the toner base particles or an aggregate of the toner particles is referred to as a toner. In general, the toner base particles can be directly used as the toner particles, and may be used as the toner particles by adding the external additive to the toner base particles. The external additive includes, for example, a fluidizer, a cleaning aid, and the like.

The color toner is based on a yellow toner (Y) containing a yellow-based coloring agent, a magenta toner (M) containing a magenta-based coloring agent, a cyan toner (C) containing a cyan-based coloring agent, and a black toner (K) containing a black-based coloring agent (hereinafter, also simply abbreviated as YMCK), which are basic colors of a color material to be used. The color toner may further contain toners of chromatic colors other than YMCK (for example, an orange toner, a violet toner, and the like). By containing such toners of other chromatic colors, it is possible to increase a color reproduction range. Such a color toner based on YMCK is capable of forming an image of various color hues and of obtaining a high-definition full-color image, by superimposing each of the toners. Accordingly, it is desirable that such toners are excellently fused each other by heat at the time of fixing. It is desirable that the binding resin in the color toner includes a polyester resin that can be fixed at a low temperature, and it is preferable that the color toner required for high definition is manufactured by an emulsion association method (also referred to as an emulsion aggregation method).

On the other hand, the special color toner is a toner not containing the coloring agent of the basic color. Examples of the special color toner include a white toner (W) containing a white coloring agent such as titanium oxide, a metallic toner (ME) containing a metallic coloring agent that exhibits metallic luster, such as an aluminum powder, a transparent toner (a clear toner (CL)) not containing a coloring agent, a gray toner containing a gray coloring agent, a gold-colored toner containing a gold-colored coloring agent, a silver-colored toner containing a silver-colored coloring agent, a fluorescent toner containing a fluorescent coloring agent, and the like. However, the special color toner is not limited thereto. Examples of the fluorescent toner include a fluorescent white toner, a fluorescent yellow toner, a fluorescent magenta toner, a fluorescent cyan toner, or the like. However, the special color toner is not limited thereto. The special color toner is a toner that is used for forming an image, as a simple color other than YMCK that are the color toner, and is also referred to as a spot color. Such special color toners are used for improving an added value of an image. Among them, the white toner, the metallic toner, the gray toner, the gold-colored toner, the silver-colored toner, the fluorescent toner, and the transparent toner are a toner group having a particularly high added value. Such special color toners can be used as a simple color for expressing a color that is not capable of being expressed by the color toner or for increasing color development or luster of the color toner by being contained in the upper layer or the lower layer of the color toner. In particular, in the case of using a transparent film as the recording medium (media), it is possible to improve visibility of the color toner and to increase an added value as an image, by forming an image on the white toner layer with the color toner. It is preferable that the special color toner contains a polyester resin that can be fixed at a low temperature, and it is preferable that the special color toner is manufactured by an emulsion association method in which high definition can be attained.

In the toner forming the upper layer in contact with the fixing member of this embodiment, two types of waxes are used together as the mold release agent. Two types of waxes consists of the first mold release agent containing the ester wax and the second mold release agent containing the microcrystalline wax. In a toner forming a layer other than the upper layer, a known mold release agent of the related art can be used as the mold release agent without any particular limitation, and it is preferable to use the same mold release agent as that of the upper layer. Accordingly, hereinafter, an example will be described in which toners containing the same mold release agent are used in the upper layer and the layer other than the upper layer.

It is preferable that a total content of the first mold release agent and the second mold release agent is greater than or equal to 5 mass % and less than or equal to 30 mass %, in the toner. The fact that such a range is preferable is as described above.

(First Mold Release Agent)

It is sufficient that the first mold release agent contains the ester wax, and it is preferable to use the first mold release agent having a melting point of higher than or equal to 68° C. and lower than 80° C. By using the first mold release agent having a melting point in the range described above, it is possible to reduce fixing energy.

The ester wax has at least an ester structure.

Any of monoester, diester, triester, and tetraester can be used as ester. For example, esters such as of higher fatty acid and higher alcohol having a structure represented by General Formulas (1), (2), and (3) described below, trimethylol propane triesters having a structure represented by General Formula (4) described below, glycerin triesters having a structure represented by General Formula (5) described below, pentaerythritol tetraesters having a structure represented by General Formula (6) described below, and the like can be exemplified.

$$R^1—COO—R^2 \qquad \text{General Formula (1)}$$

$$R^1—COO—(CH_2)_n—OCO—R^2 \qquad \text{General Formula (2)}$$

$$R^1—OCO—(CH_2)_n—COO—R^2 \qquad \text{General Formula (3)}$$

In the General Formulas (1), (2), and (3), $R^1$ and $R^2$ each independently represent a substituted or unsubstituted hydrocarbon group having carbon atoms of greater than or equal to 13 and less than or equal to 30. $R^1$ and $R^2$ may be identical to each other, or may be different from each other. n represents an integer of greater than or equal to 1 and less than or equal to 30.

$R^1$ and $R^2$ represent the hydrocarbon group having carbon atoms of greater than or equal to 13 and less than or equal to 30, and are preferably a hydrocarbon group having carbon atoms of greater than or equal to 17 and less than or equal to 22.

n represents an integer of greater than or equal to 1 and less than or equal to 30, and is preferably an integer of greater than or equal to 1 and less than or equal to 12.

General Formula (4)

$$\begin{array}{c} CH_2—OCOR^1 \\ | \\ R^4—C—CH_2—OCOR^2 \\ | \\ CH_2—OCOR^3 \end{array}$$

In the General Formula (4), $R^1$, $R^2$, $R^3$, and $R^4$ each independently represent a substituted or unsubstituted hydrocarbon group having 13 to 30 carbon atoms. $R^1$, $R^2$, $R^3$, and $R^4$ may be identical to each other, or may be different from each other.

$R^1$, $R^2$, $R^3$, and $R^4$ represent the hydrocarbon group having carbon atoms of greater than or equal to 13 and less than or equal to 30, and are preferably a hydrocarbon group having carbon atoms of greater than or equal to 17 and less than or equal to 22.

General Formula (5)

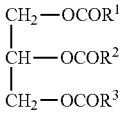

In the General Formula (5), $R^1$, $R^2$, and $R^3$ each independently represent a substituted or unsubstituted hydrocarbon group having carbon atoms of greater than or equal to 13 and less than or equal to 30. $R^1$, $R^2$, and $R^3$ may be identical to each other, or may be different from each other.

$R^1$, $R^2$, and $R^3$ represent the hydrocarbon group having carbon atoms of greater than or equal to 13 and less than or equal to 30, and are preferably a hydrocarbon group having carbon atoms of greater than or equal to 17 and less than or equal to 22.

General Formula (6)

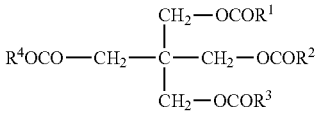

In the General Formula (6), $R^1$, $R^2$, $R^3$, and $R^4$ each independently represent a substituted or unsubstituted hydrocarbon group having carbon atoms of greater than or equal to 13 and less than or equal to 30. $R^1$, $R^2$, $R^3$, and $R^4$ may be identical to each other, or may be different from each other.

$R^1$, $R^2$, $R^3$, and $R^4$ represent the hydrocarbon group having carbon atoms of greater than or equal to 13 and less than or equal to 30, and are preferably a hydrocarbon group having carbon atoms of greater than or equal to 17 and less than or equal to 22.

A substituent that $R^1$, $R^2$, $R^3$, and $R^4$ may have is not particularly limited so long as the effects of the present invention are not be impaired. Specifically, for example, a linear or branched alkyl group, an alkenyl group, an alkynyl group, an aromatic hydrocarbon ring group, an aromatic heterocyclic group, a non-aromatic hydrocarbon ring group, a non-aromatic heterocyclic group, an alkoxy group, a cycloalkoxy group, an aryloxy group, an alkyl thio group, a cycloalkyl thio group, an aryl thio group, an alkoxy carbonyl group, an aryloxy carbonyl group, a sulfamoyl group, an acyl group, an acyloxy group, an amide group, a carbamoyl group, a ureide group, a sulfinyl group, an alkyl sulfonyl group, an aryl sulfonyl group or a heteroaryl sulfonyl group, an amino group, a halogen atom, a fluorohydrocarbon group, a cyano group, a nitro group, a hydroxy group, a thiol group, a silyl group, a deuterium atom, and the like are exemplified.

For example, a compound having a structure represented by Formula (1-1) to Formula (1-8) described below can be exemplified as specific examples of monoester having a structure represented by the General Formula (1) described above.

$CH_3—(CH_2)_{12}—COO—(CH_2)_{13}—CH_3$ General Formula (1-1)

$CH_3—(CH_2)_{14}—COO—(CH_2)_{15}—CH_3$ General Formula (1-2)

$CH_3—(CH_2)_{16}—COO—(CH_2)_{17}—CH_3$ General Formula (1-3)

$CH_3—(CH_2)_{16}—COO—(CH_2)_{21}—CH_3$ General Formula (1-4)

$CH_3—(CH_2)_{20}—COO—(CH_2)_{17}—CH_3$ General Formula (1-5)

$CH_3—(CH_2)_{20}—COO—(CH_2)_{21}—CH_3$ General Formula (1-6)

$CH_3—(CH_2)_{25}—COO—(CH_2)_{25}—CH_3$ General Formula (1-7)

$CH_3—(CH_2)_{28}—COO—(CH_2)_{29}—CH_3$ General Formula (1-8)

For example, a compound having a structure represented by Formula (2-1) to Formula (2-7) and Formula (3-1) to Formula (3-3) described below can be exemplified as specific examples of diester having a structure represented by the General Formula (2) and the General Formula (3) described above.

$CH_3—(CH_2)_{20}—COO—(CH_2)_4—OCO—(CH_2)_{20}—CH_3$ General Formula (2-1)

$CH_3—(CH_2)_{18}—COO—(CH_2)_4—OCO—(CH_2)_{18}—CH_3$ General Formula (2-2)

$CH_3—(CH_2)_{20}—COO—(CH_2)_2—OCO—(CH_2)_{20}—CH_3$ General Formula (2-3)

$CH_3—(CH_2)_{22}—COO—(CH_2)_2—OCO—(CH_2)_{22}—CH_3$ General Formula (2-4)

$CH_3—(CH_2)_{16}—COO—(CH_2)_4—OCO—(CH_2)_{16}—CH_3$ General Formula (2-5)

$CH_3—(CH_2)_{26}—COO—(CH_2)_2—OCO—(CH_2)_{26}—CH_3$ General Formula (2-6)

$CH_3—(CH_2)_{20}—COO—(CH_2)_6—OCO—(CH_2)_{20}—CH_3$ General Formula (2-7)

$CH_3—(CH_2)_{21}—COO—(CH_2)_6—OCO—(CH_2)_{21}—CH_3$ General Formula (3-1)

$CH_3—(CH_2)_{23}—COO—(CH_2)_6—OCO—(CH_2)_{23}—CH_3$ General Formula (3-2)

$CH_3—(CH_2)_{19}—COO—(CH_2)_6—OCO—(CH_2)_{19}—CH_3$ General Formula (3-3)

For example, a compound having a structure represented by Formula (4-1) to Formula (4-6) described below can be exemplified as specific examples of triester having a structure represented by the General Formula (4) described above.

General Formula (4-1)

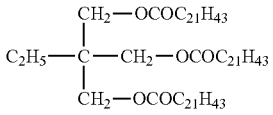

-continued

General Formula (4-2)

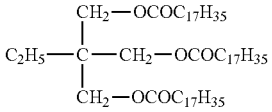

General Formula (4-3)

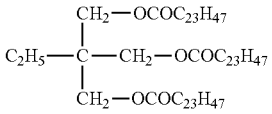

General Formula (4-4)

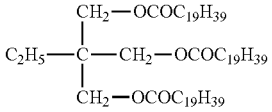

General Formula (4-5)

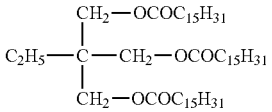

General Formula (4-6)

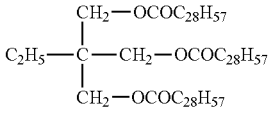

For example, a compound having a structure represented by Formula (5-1) to Formula (5-6) described below can be exemplified as specific examples of triester having a structure represented by the General Formula (5) described above.

General Formula (5-1)

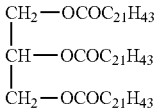

General Formula (5-2)

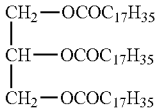

General Formula (5-3)

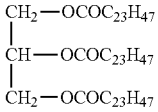

General Formula (5-4)

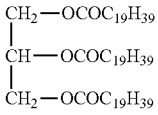

General Formula (5-5)

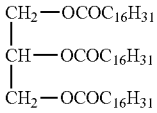

General Formula (5-6)

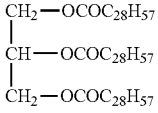

For example, a compound having a structure represented by Formula (6-1) to Formula (6-5) described below can be exemplified as specific examples of tetraester having a structure represented by the General Formula (6) described above.

General Formula (6-1)

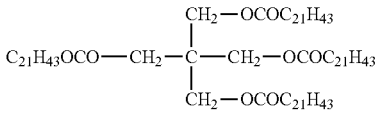

General Formula (6-2)

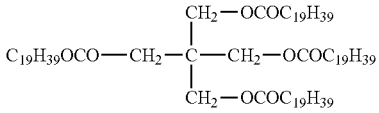

General Formula (6-3)

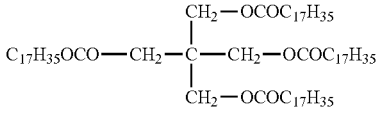

General Formula (6-4)

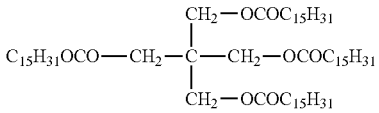

General Formula (6-5)

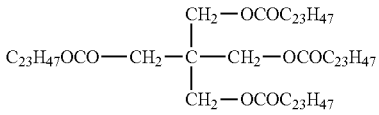

Among them, monoester is preferable as the ester.

In addition, the ester wax configuring the first mold release agent may have a plurality of monoester structures, diester structures, triester structures, and tetraester structures, in one molecule. It is preferable that the ester wax is behenyl behenate, glycerin tribehenate, and pentaerythritol tetrabehenate, from the viewpoint of a low melting point and a low viscosity.

In addition, in the first mold release agent, the ester waxes can be singly used or two or more types thereof can be used by being combined.

A total content of a mold release agent including the first mold release agent and the second mold release agent is preferably greater than or equal to 5 mass % and less than or equal to 30 mass %, and is more preferably in a range of greater than or equal to 13 mass % and less than or equal to 17 mass %, in the toner.

In a case where the first mold release agent contains a plurality of types of ester waxes having different carbon chain lengths, a content of the ester wax that is the highest content is preferably greater than or equal to 70 mass %, and is more preferably greater than or equal to 80 mass %, in the first mold release agent.

(Second Mold Release Agent)

The second mold release agent contains the microcrystalline wax.

Here, the microcrystalline wax is different from paraffin wax having as a main component linear hydrocarbon (normal paraffin) in petroleum wax, and indicates wax containing branched hydrocarbon (isoparaffin) or cyclic hydrocarbon (cycloparaffin) in a large amount in addition to linear hydrocarbon. In general, the microcrystalline wax contains low-crystalline isoparaffin or cycloparaffin in a large amount, and thus, has smaller crystals compared to the paraffin wax, and has a larger molecular weight compared to the paraffin wax.

In such microcrystalline wax, the number of carbon atoms greater than or equal to 30 and less than or equal to 60, a weight average molecular weight is greater than or equal to 500 and less than or equal to 800, and a melting point is higher than or equal to 60° C. and lower than or equal to 90° C. In the microcrystalline wax, it is preferable that the weight average molecular weight is greater than or equal to 600 and less than or equal to 800, and the melting point is higher than or equal to 60° C. and lower than or equal to 85° C. In addition, microcrystalline wax having a low molecular weight, in particular, having a number average molecular weight of greater than or equal to 300 and less than or equal to 1000, and is more preferably of greater than or equal to 400 and less than or equal to 800. In addition, it is preferable that a ratio (Mw/Mn) of the weight average molecular weight to the number average molecular weight is greater than or equal to 1.01 and less than or equal to 1.20.

Specific examples of the microcrystalline wax include microcrystalline wax such as HNP-0190, Hi-Mic-1045, Hi-Mic-1070, Hi-Mic-1080, Hi-Mic-1090, Hi-Mic-2045, Hi-Mic-2065, and Hi-Mic-2095, manufactured by NIPPON SEIRO CO., LTD., waxes EMW-0001 and EMW-0003, manufactured by NIPPON SEIRO CO., LTD., which contains isoparaffin as a main component, and the like.

In addition, in the microcrystalline wax, a ratio of a branch is preferably greater than or equal to 0.1 mol % and less than or equal to 20 mol %, and is more preferably greater than or equal to 0.3 mol % and less than or equal to 10 mol %. In a case where the ratio of the branch, that is, a total ratio of tertiary carbon atoms and quaternary carbon atoms in total carbon atoms configuring the microcrystalline wax is in the range described above, it is possible to reliably obtain molecular entanglement according to a mutual interaction with the ester wax while having a low melting point. Accordingly, it is difficult for the mold release agent to be moved to the surface of the toner base particles.

Specifically, the ratio of the branch in the microcrystalline wax can be calculated by Expression (i) described below from a spectrum that is obtained by a $^{13}$C-NMR measurement method in the following conditions.

$$\text{Ratio(\%) of Branch}=(C3+C4)/(C1+C2+C3+C4)\times 100 \quad \text{Expression (i)}$$

In the Expression (i), C1 represents a peak area according to a primary carbon atom, C2 represents a peak area according to a secondary carbon atom, C3 represents a peak area according to a tertiary carbon atom, and C4 represents a peak area according to a quaternary carbon atom.

The conditions of the $^{13}$C-NMR measurement method are as follows.

Measurement Device: FT NMR Device Lambda 400 (manufactured by JEOL Ltd.),

Measurement Frequency: 100.5 MHz,

Pulse Condition: 4.0 μs,

Data Point: 32768,

Delay Time: 1.8 sec,

Frequency Range: 27100 Hz,

Cumulated Number: 20000 times,

Measurement Temperature: 80° C.,

Solvent: Benzene-$d^6$/o-Dichlorobenzene-$d^4$=1/4 (v/v),

Sample Concentration: 3 mass %,

Sample Tube: Diameter of 5 mm, and

Measurement Mode: $^1$H Complete Coupling Method.

The mold release agent of this embodiment may contain other mold release agents in addition to the ester wax (the first mold release agent), the microcrystalline wax (the second mold release agent), so long as the effects of this embodiment are not impaired. The other mold release agent is not particularly limited, and various known waxes of the related art can be used, in addition to the ester wax and the microcrystalline wax. Examples of the other mold release agent include low-molecular weight polypropylene wax, polyethylene wax, low-molecular weight oxidized polypropylene wax, polyolefin wax such as polyethylene wax, paraffin wax, and the like.

An average particle diameter of the mold release agent of this embodiment is preferably greater than or equal to 10 nm and less than or equal to 1000 nm, and is more preferably greater than or equal to 50 nm and less than or equal to 500 nm.

(Binding Resin)

The binding resin may be a known resin that is used in a toner, and is not particularly limited. In general, any of an amorphous resin and a crystalline resin can be used as the binding resin. For example, an amorphous vinyl resin, a crystalline polyester resin, and the like can be used. Any one or both of the amorphous vinyl resin and the crystalline polyester resin may be used. In particular, the crystalline polyester resin is contained as a fixing aid, and thus, it is possible to further reduce the fixing energy. In addition, it is preferable to use the amorphous resin or to use the amorphous resin and the crystalline polyester resin in combination, and it is more preferable to use the amorphous polyester resin and the crystalline polyester resin in combination, as the binding resin, from the viewpoint of the low-temperature fixing properties and heat-resistant preservability of the toner.

(Amorphous Resin)

The amorphous resin is not particularly limited, and specifically, examples of the amorphous resin include an amorphous vinyl resin, an amorphous polyester resin, and the like.

In an endothermic curve that is obtained by differential scanning calorimetry (DSC), the amorphous resin is defined as a resin not having a clear endothermic peak at a temperature increase. That is, in the endothermic curve obtained at the time of performing the differential scanning calorimetry (DSC), the amorphous resin is a resin that does not have a melting point (that is, not having a clear endothermic peak at a temperature increase, as described above), but has a comparatively high glass transition temperature (Tg). Here, in the differential scanning calorimetry (DSC), the "clear endothermic peak" indicates a peak having a half-value width of an endothermic peak within 15° C. at the time of being measured at a temperature increase rate of 10° C./min. The endothermic curve, for example, can be measured by using a differential scanning calorimeter "Diamond DSC" (manufactured by PerkinElmer Co., Ltd.).

Note that, the glass transition temperature (Tg) of the amorphous resin described above is preferably higher than or equal to 35° C. and lower than or equal to 80° C., and is more preferably higher than or equal to 45° C. and lower than or equal to 65° C., from the viewpoint of retaining a higher balance between the low-temperature fixing properties and the fixing separation properties.

The glass transition temperature described above can be measured in accordance with the DSC method described above. In the measurement, a differential scanning calorimeters "Diamond DSC" (manufactured by PerkinElmer Co., Ltd.), a DSC-7 differential scanning calorimeter (manufactured by PerkinElmer Co., Ltd.), a TAC7/DX thermal analysis device controller (manufactured by PerkinElmer Co., Ltd.), and the like can be used.

A weight average molecular weight (Mw) of the amorphous resin described above is preferably greater than or equal to 20000 and less than or equal to 150000, and is more preferably greater than or equal to 25000 and less than or equal to 130000, from the viewpoint of easily controlling the plasticity of the amorphous resin. In addition, a number average molecular weight (Mn) of the amorphous resin is preferably greater than or equal to 5000 and less than or equal to 150000, and is more preferably greater than or equal to 8000 and less than or equal to 70000, from the viewpoint of easily controlling the plasticity of the amorphous resin. A molecular weight of the amorphous resin can be measured by the same measurement method of the molecular weight of the crystalline resin described above.

(Amorphous Vinyl Resin)

The amorphous vinyl resin is formed by using a monomer having a vinyl group (hereinafter, referred to as a "vinyl monomer"). Examples of the amorphous vinyl resin include a styrene-acryl resin, a styrene resin, an acryl resin, and the like, and among them, the styrene-acryl resin is preferable.

Examples of the vinyl monomer include the follows.

(1) Styrene-Based Monomer

Examples of a styrene-based monomer include styrene, o-methyl styrene, m-methyl styrene, p-methyl styrene, α-methyl styrene, p-phenyl styrene, p-ethyl styrene, 2,4-dimethyl styrene, p-t-butyl styrene, p-n-hexyl styrene, p-n-octyl styrene, p-n-nonyl styrene, p-n-decyl styrene, p-n-dodecyl styrene, derivatives thereof, and the like.

(2) (Meth)Acrylic Acid Ester-Based Monomer

Examples of a (meth)acrylic acid ester-based monomer include methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethyl hexyl (meth)acrylate, stearyl (meth)acrylate, lauryl (meth)acrylate, phenyl (meth)acrylate, diethyl aminoethyl (meth)acrylate, dimethyl aminoethyl (meth)acrylate, derivatives thereof, and the like.

(3) Vinyl Esters

Examples of vinyl esters include vinyl propionate, vinyl acetate, vinyl benzoate, and the like.

(4) Vinyl Ethers

Examples of vinyl ethers include vinyl methyl ether, vinyl ethyl ether, and the like.

(5) Vinyl Ketones

Examples of vinyl ketones include vinyl methyl ketone, vinyl ethyl ketone, vinyl hexyl ketone, and the like.

(6) N-Vinyl Compounds

Examples of N-vinyl compounds include N-vinyl carbazole, N-vinyl indole, N-vinyl pyrrolidone, and the like.

(7) Others

Examples of other vinyl monomers in addition to (1) to (6) described above include vinyl compounds such as vinyl naphthalene and vinyl pyridine, acrylic acid or methacrylic acid derivatives such as acrylonitrile, methacrylonitrile, and acryl amide, and the like.

Only one type of the vinyl monomers described above can be independently used, or two or more types thereof can be used by being combined.

In addition, for example, it is preferable to use a monomer having an ionic dissociable group such as a carboxy group, a sulfonic acid group, and a phosphoric acid group, as the vinyl monomer. Specifically, the followings are exemplified.

Examples of a monomer having a carboxy group include an acrylic acid, a methacrylic acid, a maleic acid, an itaconic acid, a cinnamic acid, a fumaric acid, monoalkyl maleic acid ester, monoalkyl itaconic acid ester, and the like.

Examples of a monomer having a sulfonic acid group include styrene sulfonate, allyl sulfosuccinate, 2-acryl amide-2-methyl propane sulfonate, and the like.

Examples of a monomer having a phosphoric acid group include acid phosphoxy ethyl methacrylate, and the like.

Further, polyfunctional vinyls may be used as the vinyl monomer, and a vinyl polymer may have a crosslinking structure.

Examples of the polyfunctional vinyls include divinyl benzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

The content of the amorphous vinyl resin in the binding resin is preferably greater than or equal to 50 mass %, and is more preferably greater than or equal to 70 mass %.

(Amorphous Polyester Resin)

It is preferable that the toner contains the amorphous polyester resin, as the binding resin, from the viewpoint of further improving the low-temperature fixing properties.

The amorphous polyester resin is a resin having a comparatively high glass transition point (Tg) but not a clear melting point, in known polyester resins obtained by a polycondensation reaction between a divalent or higher carboxylic acid component (a polyvalent carboxylic acid component) and a divalent or higher alcohol component (a polyhydric alcohol component). This can be checked by performing differential scanning calorimetry (DSC) with respect to the amorphous polyester resin. In addition, the amorphous polyester resin has a monomer that is different from the monomer configuring the crystalline polyester resin, and thus, for example, it is possible to discriminate the crystalline polyester resin even by analysis such as NMR.

The amorphous polyester resin is not particularly limited, and known amorphous polyester resins of the related art in this technical field can be used.

<<Constituent Component of Amorphous Polyester Resin>>

(Polyvalent Carboxylic Acid Component)

An unsaturated aliphatic polyvalent carboxylic acid, an aromatic polyvalent carboxylic acid, and derivatives thereof are preferable as the polyvalent carboxylic acid component configuring the amorphous polyester resin. Further, it is more preferable to contain the unsaturated aliphatic polyvalent carboxylic acid, as the polyvalent carboxylic acid component, from the viewpoint of further accelerating compatibleness with the crystalline polyester resin, and of improving the low-temperature fixing properties. A saturated aliphatic polyvalent carboxylic acid may be used insofar as an amorphous resin can be formed.

Examples of the unsaturated aliphatic polyvalent carboxylic acid described above include an unsaturated aliphatic dicarboxylic acid such as methylene succinic acid, a fumaric acid, a maleic acid, 3-hexenedioic acid, a 3-octenedioic acid, and a succinic acid substituted with an alkyl group having carbon atoms of greater than or equal to 1 and less than or equal to 20 or an alkenyl group having carbon atoms of greater than or equal to 2 and less than or equal to 20: an unsaturated aliphatic tricathoxylic acid such as 3-butene-1,2,3-tricarboxylic acid, 4-pentene-1,2,4-tricarboxylic acid, and an aconitic acid; an unsaturated aliphatic tetracarboxylic acid such as 4-pentene-1,2,3,4-tetracarboxylic acid, and the like, and lower alkyl esters or acid anhydrides thereof can also be used.

Specific examples of the succinic acid substituted with an alkyl group having carbon atoms of greater than or equal to 1 and less than or equal to 20 or an alkenyl group having carbon atoms of greater than or equal to 2 and less than or equal to 20 include dodecyl succinate, dodecenyl succinate, octenyl succinate, decenyl succinate, and the like. In addition, lower alkyl esters or acid anhydrides thereof can also be used.

Examples of the aromatic polyvalent carboxylic acid described above include an aromatic dicarboxylic acid such as a phthalic acid, a terephthalic acid, an isophthalic acid, t-butyl isophthalate, a tetrachlorophthalic acid, a chlorophthalic acid, a nitrophthalic acid, a p-phenylene diacetic acid, a 2,6-naphthalene dicarboxylic acid, a 4,4'-biphenyl dicarboxylic acid, and an anthracene dicarboxylic acid; an aromatic tricarboxylic acid such as 1,2,4-benzene tricarboxylic acid (a trimellitic acid), 1,2,5-benzene tricarboxylic acid (a trimesic acid), 1,2,4-naphthalene tricarboxylic acid, and a hemimellitic acid; an aromatic tetracarboxylic acid such as a pyromellitic acid and 1,2,3,4-butane tetracarboxylic acid; an aromatic hexacarboxylic acid such as a mellitic acid, and the like, and lower alkyl esters or acid anhydrides thereof can also be used.

Examples of the saturated aliphatic polyvalent carboxylic acid include a saturated aliphatic dicarboxylic acid (for example, a dodecanedioic acid and the like), in the polyvalent carboxylic acid components described in the section of the crystalline polyester resin described below.

The number of carbon atoms of the dicarboxylic acid is not particularly limited, but is preferably greater than or equal to 1 and less than or equal to 20, is more preferably greater than or equal to 2 and less than or equal to 15, and is even more preferably greater than or equal to 3 and less than or equal to 12, from the viewpoint of easily optimizing thermal properties. The dicarboxylic acids may be independently used, or two or more types thereof may be used by being mixed.

The number of carbon atoms of a trivalent or higher polyvalent carboxylic acid component is not particularly limited, but is preferably greater than or equal to 3 and less than or equal to 20, is more preferably greater than or equal to 5 and less than or equal to 15, and is even more preferably greater than or equal to 6 and less than or equal to 12, from the viewpoint of easily optimizing the thermal properties. The polyvalent carboxylic acid components may be independently used, or two or more types thereof may be used by being mixed.

(Polyvalent Alcohol Component)

Unsaturated aliphatic polyhydric alcohol, aromatic polyhydric alcohol, and derivatives thereof are preferable as the polyhydric alcohol component configuring the amorphous polyester resin, from the viewpoint of improving charging properties or a toner strength. Saturated aliphatic polyhydric alcohol may be used insofar as the amorphous polyester resin can be formed.

Examples of the unsaturated aliphatic polyhydric alcohol described above include unsaturated aliphatic diol such as 2-butene-1,4-diol, 3-butene-1,4-diol, 2-butyne-1,4-diol, 3-butyne-1,4-diol, and 9-octadecene-7,12-diol. In addition, examples of the saturated aliphatic polyhydric alcohol described above include glycerin, trimethylol propane, pentaerythritol, sorbitol, and the like. Further, derivatives thereof can also be used.

Examples of the aromatic polyhydric alcohol described above include bisphenols such as bisphenol A and bisphenol F, and alkylene oxide adducts of bisphenols such as ethylene oxide adducts and propylene oxide adducts thereof, 1,3,5-benzene triol, 1,2,4-benzene triol, 1,3,5-trihydroxy methyl benzene, and the like, and derivatives thereof can also be used. Among them, a bisphenol A-based compound such as the ethylene oxide adduct and the propylene oxide adduct of bisphenol A is preferably used, in particular, from the viewpoint of improving charging homogeneousness of the toner and of easily optimizing the thermal properties.

The polyhydric alcohol components may be independently used, or two or more types thereof may be used by being mixed.

The number of carbon atoms of the polyhydric alcohol component is not particularly limited, but is preferably greater than or equal to 3 and less than or equal to 30, from the viewpoint of easily optimizing the thermal properties.

A manufacturing method of the amorphous polyester resin is not particularly limited, and the resin can be manufactured with a known esterification catalyst by polycondensing (esterifying) the polyvalent carboxylic acid component and the polyhydric alcohol component described above.

Examples of the catalyst that can be used in the manufacturing include an alkali metal compound such as sodium and lithium; a compound containing a group 2 element such as magnesium and calcium; a metal compound such as aluminum, zinc, manganese, antimony, titanium, tin, zirconium, and germanium; a phosphorus acid compound; a phosphoric acid compound; an amine compound, and the like. In consideration of availability or the like, it is preferable to use dibutyl tin oxide, tin octylate, tin dioctylate, and salts thereof, or tetranormal butyl titanate (tetrabutyl orthotitanate and $Ti(O\text{-}n\text{-}Bu)_4$), tetraisopropyl titanate (titanium tetraisopropoxide), tetramethyl titanate, tetrabutoxy titanium (titanium tetrabutoxide), and the like. Only one type of the catalysts may be independently used, or two or more types thereof may be used by being combined.

A polycondensation (esterification) temperature is not particularly limited, but is preferably higher than or equal to 150° C. and lower than or equal to 250° C. In addition, a polycondensation (esterification) time is not particularly limited, but preferably longer than or equal to 0.5 times and shorter than or equal to 15 times. In the polycondensation, as necessary, a reaction system may be depressurized.

In addition, the amorphous polyester resin may be a vinyl-modified amorphous polyester resin having a block copolymer structure in which to a vinyl polymerization segment (a vinyl resin segment) is chemically bonded an amorphous polyester polymerization segment containing the polyvalent carboxylic acid component and the polyhydric alcohol component described above. Examples of such a vinyl-modified amorphous polyester resin preferably include a styrene acryl-modified amorphous polyester resin. Hereinafter, the styrene acryl-modified amorphous polyester resin that is a preferred aspect of the vinyl-modified amorphous polyester resin will be described.

<<Styrene Acryl-Modified Amorphous Polyester Resin>>

The styrene acryl-modified amorphous polyester resin is a resin configured of polyester molecules having a block copolymer structure in which an amorphous polyester polymerization segment (an amorphous polyester resin segment) and a styrene acryl polymerization segment (a styrene acryl copolymer segment) are chemically bonded to each other. Only one type of the styrene acryl-modified amorphous polyester resins may be independently used, or two or more types thereof may be used together.

A forming method of the amorphous polyester polymerization segment is not particularly limited. A specific type of polyvalent carboxylic acid component and polyhydric alcohol component used in used in the formation of the polymerization segment, and a polycondensation condition of monomers thereof are the same as described above, and thus, the description thereof will be omitted.

On the other hand, the styrene acryl polymerization segment configuring the styrene acryl-modified amorphous polyester resin is formed at least by performing an addition polymerization between (1) the styrene monomer and (2) the (meth)acrylic acid ester monomer. The monomers described in the section of [Styrene Acryl Resin] described above can be used as the styrene monomer and the (meth)acrylic acid ester monomer. Among them, styrene is preferable as the styrene monomer. In addition, n-butyl acrylate is preferable as the (meth)acrylic acid ester monomer.

The styrene acryl polymerization segment may be formed by further using the following monomers in addition to the monomers described above.

(3) Vinyl Esters

Examples of vinyl esters include vinyl propionate, vinyl acetate, vinyl benzoate, and the like.

(4) Vinyl Ethers

Examples of vinyl ethers include vinyl methyl ether, vinyl ethyl ether, and the like.

(5) Vinyl Ketones

Examples of vinyl ketones include vinyl methyl ketone, vinyl ethyl ketone, vinyl hexyl ketone, and the like.

(6) N-Vinyl Compounds

Examples of N-vinyl compounds include N-vinyl carbazole, N-vinyl indole, N-vinyl pyrrolidone, and the like.

(7) Other Monomers

Examples of other monomers in addition to (1) to (6) described above include vinyl compounds such as vinyl naphthalene and vinyl pyridine, acrylic acid or methacrylic acid derivatives such as acrylonitrile, methamlonitrile, and acryl amide, and the like.

A forming method of the styrene acryl polymerization segment is not particularly limited, a method of performing polymerization by a known polymerization method such as bulk polymerization, solution polymerization, an emulsion polymerization method (an emulsion association method), a miniemulsion method, and a dispersion polymerization method, by using an arbitrary polymerization initiator that is generally used in the polymerization of the monomer described above, such as a peroxide, a persulfide, a persulfate, and an azo compound.

A content ratio of the amorphous polyester polymerization segment in the styrene acryl-modified amorphous polyester resin is not particularly limited, but is preferably greater than or equal to 60 mass % and less than or equal to 95 mass %, and is more preferably greater than or equal to 70 mass % and less than or equal to 85 mass %.

A content ratio of the styrene acryl polymerization segment in the styrene acryl-modified amorphous polyester resin (hereinafter, a "modification amount of styrene acryl") is preferably greater than or equal to 5 mass % and less than or equal to 40 mass %, and is more preferably greater than or equal to 10 mass % and less than or equal to 30 mass %.

Specifically, the modification amount of styrene acryl indicates a total mass ratio of the styrene monomer and the (meth)acrylic acid ester monomer with respect to a total mass of a resin raw material that is used for synthesizing the styrene acryl-modified amorphous polyester resin. The total mass of the resin raw material indicates a total mass in which a monomer to be the amorphous polyester polymerization segment (excluding a bireactive monomer), a styrene monomer to be the styrene acryl polymerization segment, the (meth)acrylic acid ester monomer, and a bireactive monomer for bonding the monomers are totalized.

Here, the "bireactive monomer" is a monomer for bonding the styrene acryl polymerization segment and the amorphous polyester polymerization segment to each other. Specifically, the "bireactive monomer" is a monomer having both of a group selected from a hydroxy group, a carboxy group, an epoxy group, a primary amino group, and a secondary amino group, forming the amorphous polyester polymerization segment, and an ethylenically unsaturated group for forming the styrene acryl polymerization segment, in molecules.

Specific examples of the bireactive monomer include an acrylic acid, a methacrylic acid, a fumaric acid, a maleic acid, and the like, and may be esters of hydroxy alkyls (carbon atoms of greater than or equal to 1 and less than or equal to 3) thereof. The acrylic acid, the methacrylic acid, or the fumaric acid is preferable as the bireactive monomer, from the viewpoint of reactivity. The styrene acryl polymerization segment and the amorphous polyester polymerization segment are bonded to each other through the bireactive monomer.

A use amount of the bireactive monomer is preferably greater than or equal to 1 mass % and less than or equal to 20 mass %, and is more preferably greater than or equal to 5 mass % and less than or equal to 15 mass %, with respect to a total amount of the monomer configuring the styrene acryl polymerization segment, from the viewpoint of improving the low-temperature fixing properties.

A manufacturing method of the styrene acryl-modified amorphous polyester resin is not particularly limited insofar as it is possible to form a polymer having a structure in which the amorphous polyester polymerization segment and the styrene acryl polymerization segment are chemically bonded to each other by the method. Specific manufacturing methods of the styrene acryl-modified amorphous polyester resin include the following methods.

(A) There is a method in which the amorphous polyester polymerization segment is polymerized in advance. Next, the bireactive monomer is reacted with the amorphous polyester polymerization segment, and the styrene monomer for forming the styrene acryl polymerization segment and the (meth)acrylic acid ester monomer are reacted with each other, and thus, the styrene acryl polymerization segment is formed.

(B) There is a method in which the styrene acryl polymerization segment is polymerized in advance. Next, the bireactive monomer is reacted with the styrene acryl polymerization segment, and the polyvalent carboxylic acid component for forming the amorphous polyester polymerization segment and the polyhydric alcohol component are reacted with each other, and thus, the amorphous polyester segment is formed.

(C) There is a method in which the amorphous polyester polymerization segment and the styrene acryl polymerization segment are respectively polymerized in advance, and the bireactive monomer is reacted therewith, and thus, the amorphous polyester polymerization segment and styrene acryl polymerization segment are bonded to each other.

A weight average molecular weight (Mw) of the amorphous polyester resin (the styrene acryl-modified amorphous polyester resin) is not particularly limited, but is preferably greater than or equal to 5,000 and less than or equal to 100,000, and is more preferably greater than or equal to 5,000 and less than or equal to 50,000. In a case where the weight average molecular weight described above is greater than or equal to 5,000, it is possible to improve the heat-resistant preservability of the toner, and in a case where the weight average molecular weight is less than or equal to 100,000, it is possible to further improve the low-temperature fixing properties. The weight average molecular weight (Mw) described above can be measured by a gel permeation chromatography (GPC) using polystyrene, as a standard substance.

A content rate of the amorphous polyester resin in the binding resin is preferably greater than or equal to 5 mass % and less than or equal to 30 mass %, and is more preferably greater than or equal to 10 mass % and less than or equal to 20 mass %.

(Crystalline Resin)

The crystalline resin is not particularly limited, and examples of the crystalline resin include a polyolefin-based resin, a polydiene-based resin, a crystalline polyester resin, and the like. Among them, the crystalline polyester resin is preferable from the viewpoint of improving the low-temperature fixing properties or usability. The crystalline polyester resin may be a hybrid crystalline polyester resin.

The content of the crystalline resin is preferably greater than or equal to 5 mass % and less than or equal to 20 mass %, and is more preferably greater than or equal to 7 mass % and less than or equal to 15 mass %, in the toner. In a case where the content of the crystalline resin is greater than or equal to 5 mass %, a sufficient plasticizing effect is obtained, and the low-temperature fixing properties are improved. In a case where the content of the crystalline resin is less than or equal to 20 mass %, thermal stability as the toner or stability with respect to a physical stress is improved. In a more preferred range, more excellent low-temperature fixing properties and fixing separation properties are obtained.

A melting point of the crystalline resin is preferably higher than or equal to 55° C. and lower than or equal to 80° C., and is more preferably higher than or equal to 70° C. and lower than or equal to 80° C., from the viewpoint of making the fixing properties and the thermal stability compatible.

As a molecular weight of the crystalline resin, a number average molecular weight is preferably greater than or equal to 8500 and less than or equal to 12500, and is more preferably greater than or equal to 9000 and less than or equal to 11000.

(Crystalline Polyester Resin)

The content of the crystalline polyester resin in the binding resin is preferably greater than or equal to 5 mass % and less than or equal to 20 mass %, and is more preferably greater than or equal to 7 mass % and less than or equal to 15 mass %. In a case where the content of the crystalline polyester resin is greater than or equal to 5 mass %, the low-temperature fixing properties are improved, and in a case where the content of the crystalline polyester resin is less than or equal to 20 mass %, the thermal stability as the toner or the stability with respect to a physical stress is improved, and luster unevenness is improved.

In addition, a melting point (Tmc) of the crystalline polyester resin is preferably higher than or equal to 55° C. and lower than or equal to 80° C., and is more preferably higher than or equal to 70° C. and lower than or equal to 80° C.

Note that, in this embodiment, the melting point of the crystalline resin and the crystalline polyester resin can be measured by differential scanning calorimetry (DSC) of the toner, as described above.

The crystalline polyester resin can be obtained by a polycondensation reaction between divalent or higher alcohol (a polyhydric alcohol component) and a divalent or higher carboxylic acid (a polyvalent carboxylic acid component).

The crystalline resin is defined as a resin having a clear endothermic peak at a temperature increase, in an endothermic curve obtained by differential scanning calorimetry (DSC). Here, in the differential scanning calorimetry (DSC), the "clear endothermic peak" indicates a peak having a half-value width of an endothermic peak within 15° C. at the time of being measured at a temperature increase rate of 10° C./min.

The crystalline polyester resin is not particularly limited to those described above. For example, the crystalline polyester resin may be a homopolymer that is synthesized by a polycondensation reaction between a polyhydric alcohol component and a polyvalent carboxylic acid component. Alternatively, the crystalline polyester resin may be a hybrid crystalline polyester resin in which a crystalline polyester polymerization segment that is synthesized by a polycondensation reaction between polyhydric alcohol component and a polyvalent carboxylic acid component, and an amorphous polymerization segment other than a polyester resin are copolymerized. Among them, the hybrid crystalline polyester resin is preferable.

The hybrid crystalline polyester resin is a resin in which the crystalline polyester polymerization segment and the amorphous polymerization segment other than the polyester resin are chemically bonded to each other. The crystalline polyester polymerization segment indicates a portion that is derived from the crystalline polyester resin, and the amorphous polymerization segment other than the polyester resin indicates a portion that is derived from an amorphous resin other than the polyester resin. Examples of the amorphous resin other than the polyester resin include a vinyl resin such as a styrene-acryl resin, a urethane resin, a urea resin, and the like. Only one type of the amorphous polymerization segments other than the polyester resin may be independently used, or two or more types thereof may be used by being combined.

Examples of the hybrid crystalline polyester resin include a resin having a structure in which other components are copolymerized with a main chain formed of the crystalline polyester polymerization segment, or a resin having a structure in which the crystalline polyester polymerization segment is copolymerized with a main chain formed of other components.

Examples of the polyhydric alcohol component are capable of including dihydric alcohol such as ethylene glycol, propylene glycol, butanediol, diethylene glycol, hexanediol, cyclohexanediol, octanediol, decanediol, dodecanediol, an ethylene oxide adduct of bisphenol A, and a propylene oxide adduct of bisphenol A, trivalent or higher polyol such as glycerin, pentaerythritol, hexamethylol melamine, hexaethylol melamine, tetramethylol benzoguanamine, and tetraethylol benzoguanamine, ester compounds and hydroxy carboxylic acid derivatives thereof, and the like.

Examples of the polyvalent carboxylic acid component are capable of including a divalent carboxylic acid such as an oxalic acid, a succinic acid, a maleic acid, a mesaconic acid, an adipic acid, a β-methyl adipic acid, an azelaic acid, a sebacic acid, a nonan dicarboxylic acid, a decane dicarboxylic acid, an undecane dicarboxylic acid, a dodecane dicarboxylic acid, a fumaric acid, a citraconic acid, a diglycolic acid, a cyclohexane-3,5-diene-1,2-dicarboxylic acid, a malic acid, a citric acid, a hexaydroterephthalic acid, a malonic acid, a pimelic acid, a tartaric acid, a mucic acid, a phthalic acid, an isophthalic acid, a terephthalic acid, a tetrachlorophthalic acid, a chlorophthalic acid, a nitrophthalic acid, a p-carboxy phenyl acetic acid, a p-phenylene diacetic acid, an m-phenylene diglycolic acid, a p-phenylene diglycolic acid, an o-phenylene diglycolic acid, a diphenyl acetic acid, a diphenyl-p,p'-dicarboxylic acid, a naphthalene-1,4-dicarboxylic acid, a naphthalene-1,5-dicarboxylic acid, a naphthalene-2,6-dicarboxylic acid, an anthracene dicarboxylic acid, and a dodecenyl succinic acid, a trivalent or higher carboxylic acid such as a trimellitic acid, a pyromellitic acid, a naphthalene tricarboxylic acid, a naphthalene tetracarboxylic acid, a pyrene tricarboxylic acid, and a pyrene tetracarboxylic acid, alkyl esters, acid anhydrides, and acid chlorides thereof, and the like.

It is preferable that a monomer configuring the crystalline polyester resin (the polyhydric alcohol component and the polyvalent carboxylic acid component) contains a linear aliphatic monomer of greater than or equal to 50 mass %, and it is preferable that the monomer contains the linear aliphatic monomer of greater than or equal to 80 mass %. In the case of using an aromatic monomer, a melting point of the crystalline polyester is generally high, and in the case of using a branched aliphatic monomer, crystallinity generally decreases, and thus, it is preferable to use the linear aliphatic monomer. In addition, the linear aliphatic monomer of greater than or equal to 50 mass % is contained, and thus, it is possible to maintain the crystallinity in the toner. By containing the linear aliphatic monomer of greater than or equal to 80 mass %, it is possible to maintain sufficient crystallinity.

A forming method of the crystalline polyester resin is not particularly limited, and it is possible to form the crystalline polyester resin by polycondensing (esterifying) the polyhydric alcohol component and the polyvalent carboxylic acid component described above, with a known esterification catalyst.

As use ratio of the polyhydric alcohol component to the polyvalent carboxylic acid component, an equivalent ratio of a hydroxy group of the polyhydric alcohol component to a carboxy group of the polyvalent carboxylic acid component is preferably 1.5/1 to 1/1.5, and is more preferably 1.2/1 to 1/1.2.

Examples of the catalyst that can be used at the time of manufacturing the crystalline polyester resin include an alkali metal compound such as sodium and lithium, an alkali earth metal compound such as magnesium and calcium, a metal compound such as aluminum, zinc, manganese, antimony, titanium, tin, zirconium, and germanium, a phosphorus acid compound, a phosphoric acid compound, an amine compound, and the like.

Specifically, examples of a tin compound are capable of including dibutyl tin oxide, tin ocrylate, tin dioctylate, salts thereof, and the like.

Examples of a titanium compound are capable of including titanium alkoxide such as tetranormal butyl titanate, tetraisopropyl titanate, tetramethyl titanate, and tetrastearyl titanate, titanium acylate such as polyhydroxy titanium stearate, titanium chelate such as titanium tetraacetyl acetonate, titanium lactate, and titanium triethanol aminate, and the like.

Examples of a germanium compound are capable of including germanium dioxide and the like.

Examples of an aluminum compound are capable of including an oxide such as polyaluminum hydroxide, aluminum alkoxide, tributyl aluminate, and the like.

Only one type of the catalysts may be independently used, or two or more types thereof may be used by being combined.

A polymerization temperature or a polymerization time is not particularly limited, and in the polymerization, a reaction system may be depressurized, as necessary.

In a case where the crystalline polyester resin is the hybrid crystalline polyester resin described above, it is preferable that the content of the crystalline polyester polymerization segment is greater than or equal to 50 mass % and less than 98 mass %, with respect to a total amount of the hybrid crystalline polyester resin. According to the range described above, it is possible to impart sufficient crystallinity to the hybrid crystalline polyester resin. Note that, the constituent component and the content of each polymerization segment in the hybrid crystalline polyester resin, for example, can be specified by NMR measurement and methylation reaction P-GC/MS measurement.

The hybrid crystalline polyester resin may be in any form such as a block copolymer and a graft copolymer, insofar as the crystalline polyester polymerization segment and the amorphous polymerization segment are contained, and the graft copolymer is preferable. In the case of the graft copolymer, the orientation of the crystalline polyester polymerization segment is easily controlled, and thus, it is possible to impart sufficient crystallinity to the hybrid crystalline polyester resin.

In addition, it is preferable that the crystalline polyester polymerization segment is grafted by using the amorphous polymerization segment other than the crystalline polyester resin, as a main chain. That is, it is preferable that the hybrid crystalline polyester resin is a graft copolymer having the amorphous polymerization segment other than the polyester resin, as a main chain, and the crystalline polyester polymerization segment, as a side chain.

According to the form described above, it is possible to further increase the orientation of the crystalline polyester polymerization segment, and to improve the crystallinity of the hybrid crystalline polyester resin.

Note that, a substituent such as a sulfonic acid group, a carboxy group, and a urethane group may be introduced to the hybrid crystalline polyester resin. The introduction of the substituent described above may be in the crystalline polyester polymerization segment, or may be in the amorphous polymerization segment other than the polyester resin.

In addition, it is preferable that the number of carbon atoms (C (alcohol)) of the polyhydric alcohol component and the number of carbon atoms (C (acid)) of the polyvalent carboxylic acid component satisfy relationships of Expressions (A), (B), and (C) described below.

[Numerical Expression 2]

$$C\ (\text{acid}) - C\ (\text{alcohol}) \geq 4 \qquad \text{Expression (A)}$$

$$C\ (\text{acid}) \geq 10 \qquad \text{Expression (B)}$$

$$C\ (\text{alcohol}) \leq 6 \qquad \text{Expression (C)}$$

The crystalline polyester resin in which the number of carbon atoms of a raw material is defined is formed by using the polyhydric alcohol component and the polyvalent carboxylic acid having different chain lengths of main chains, and thus, a short branched chain of carbon atoms and a long branched chain of carbon atoms are alternately bonded to a polyester chain. For this reason, it is considered that there is a portion having low regularity, in the crystallization. Therefore, the crystalline polyester resin in which the number of carbon atoms of the raw material is defined is used as the crystalline polyester resin configuring the binding resin, and thus, when thermal energy at a temperature higher than the melting point of the crystalline polyester resin is applied, in heat fixing, a portion in which the regularity of crystals is low is sequentially melted. For this reason, excellent low-temperature fixing properties can be obtained.

Expression (A) described above represents C (acid)−C (alcohol)≥4, but it is more preferable to satisfy C (acid)−C (alcohol)≥6.

Note that, in the case of containing two or more types of polyvalent carboxylic acid components, C (acid) described above is the number of carbon atoms of the polyvalent carboxylic acid component having the largest content (in terms of mol). In the case of the same amount, the number of carbon atoms of the polyvalent carboxylic acid component having the largest carbon atoms is C (acid).

Similarly, in the case of containing two or more types of polyhydric alcohol components, C (alcohol) described above is the number of carbon atoms of the polyhydric alcohol component having the largest content (in terms of mol). In the case of the same amount, the number of carbon atoms of the polyvalent carboxylic acid component having the largest carbon atoms is C (alcohol).

(Coloring Agent)

The special color toner and the color toner other than the transparent toner contain the coloring agent. A dye and a pigment that are generally known can be used as the coloring agent. That is, carbon black, a magnetic body, a dye, a pigment, and the like can be arbitrarily used as the coloring agent that is used in each of the toners. Channel black, furnace black, acetylene black, thermal black, lamp black, and the like are used as the carbon black. A ferromagnetic metal such as iron, nickel, and cobalt, an alloy containing such metals, a ferromagnetic metal compound such as ferrite and magnetite, an alloy that does not contain a ferromagnetic metal but exhibits ferromagnetic properties by heat processing, for example, a type of alloy that is referred to as a Hensler alloy such as manganese-copper-aluminum and manganese-copper-tin, chromium dioxide, and the like can be used as the magnetic body.

(Coloring Agent for Special Color Toner)

Any of an inorganic pigment and an organic pigment can be used as a white coloring agent that is used in the white toner (W). Specifically, examples of a white inorganic pigment include heavy calcium carbonate, light calcium carbonate, titanium oxide (titanium dioxide), aluminum hydroxide, titanium white, talc, calcium sulfate, barium sulfate, zinc oxide, magnesium oxide, magnesium carbonate, amorphous silica, colloidal silica, white carbon, kaolin, fired kaolin, delaminate kaolin, aluminosilicate, sericite, bentonite, smectite, and the like. Examples of a white organic pigment include polystyrene resin particles, urea formalin resin particles, and the like. In addition, a white pigment having a hollow structure, for example, hollow resin particles, hollow silica, and the like are also exemplified. It is preferable that the white coloring agent (pigment) is titanium oxide, from the viewpoint of charging properties and concealing properties. Any crystal structure such as an anatase type structure, a futile type structure, and a brookite type structure can also be used as titanium oxide.

The metallic coloring agent that is used in the metallic toner (ME) indicates a material from which a metallic hue can be obtained, and contains not only a conductive metal material, but also a material other than a metal, and a non-conductive material. Examples of such a metallic coloring agent include an aluminum pigment (an aluminum powder; a powder of aluminum or an alloy thereof), a bronze powder, a pearl pigment, and the like.

There is no particular gray coloring agent that is used in the gray toner. As described in "Synthesis of Gray Toner" of the examples, the existing black coloring agent is used, and a use amount thereof is suppressed, and thus, the gray toner can be obtained.

Examples of the gold-colored coloring agent that is used in the gold-colored toner include a gold powder, a gold foil, and the like.

Examples of the silver-colored coloring agent that is used in the silver-colored toner include a silver powder, a silver foil, and the like.

Examples of the fluorescent coloring agent that is used in the fluorescent toner include Solvent Yellow 98, Solvent Orange 63, and the like.

(Coloring Agent for Color Toner)

Various known coloring agents such as carbon black such as furnace black, channel black, acetylene black, thermal black, and lamp black, a magnetic powder of magnetite, ferrite, and the like, a dye, and an inorganic pigment containing non-magnetic iron oxide can be arbitrarily used as the black-based coloring agent that is used in the black toner (K).

Examples of an orange or yellow coloring agent that is used in the yellow toner (Y) include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, and the like.

Examples of a magenta or red coloring agent that is used in the magenta toner (M) include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, Pigment Red 184, C.I. Pigment Red 222, C.I. Pigment Red 238, and the like.

Further, examples of a green or cyan coloring agent that is used in the cyan toner (C) include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Green 7, and the like.

Examples of a coloring agent that is used in a color toner other than YMCK that are the basic color includes a pigment such as an orange toner include C.I. Pigment Orange 1 and C.I. Pigment Orange 11. In addition, examples of a coloring agent that is used in a violet toner include a pigment such as C.I. Pigment Violet 19, C.I. Pigment Violet 23, and C.I. Pigment Violet 29.

Only one type of the coloring agents that are used in toners of each color can be independently used, or two or more types thereof can be used by being combined.

An average particle diameter of the coloring agent (excluding ME) is preferably greater than or equal to 10 nm and less than or equal to 1000 nm, and is more preferably greater than or equal to 50 nm and less than or equal to 500 nm.

Examples of the shape of the metallic coloring agent include a flat shape (a scale shape). An average length of the metallic coloring agent in a long axis direction is preferably greater than or equal to 1 μm and less than or equal to 30 μm, is more preferably greater than or equal to 3 μm and less than or equal to 20 μm, and is even more preferably greater than or equal to 5 μm and less than or equal to 15 μm. A ratio (an aspect ratio) of the average length in the long axis direction when an average length of the metallic coloring agent in a thickness direction is 1 is preferably greater than or equal to 5 and less than or equal to 200, is more preferably greater than or equal to 10 and less than or equal to 100, and is even more preferably greater than or equal to 30 and less than or equal to 70.

Each of the average length and the aspect ratio of the metallic coloring agent is measured by the following method. A picture of coloring agent particles is photographed at a measurable magnification (300 times to 100,000 times), by using a scanning electron microscope (S-4800, manufactured by Hitachi High Technologies Corporation). In a state where an obtained image of the coloring agent particles is formed into a two-dimensional image, the length of each of the particles in the long axis direction and in the thickness direction is measured, and the average length and the aspect ratio of the metallic coloring agent in the long axis direction are calculated.

The content of the coloring agent is preferably greater than or equal to 2 mass % and less than or equal to 50 mass %, is more preferably greater than or equal to 5 mass % and less than or equal to 45 mass %, and is even more preferably greater than or equal to 10 mass % and less than or equal to 40 mass %, in the toner. In a case where the content of the coloring agent is greater than or equal to 2 mass %, it is possible to obtain sufficient tinctorial power, and in a case where the content of the coloring agent is less than or equal to 50 mass %, the coloring agent is not attached to a carrier by being liberated from the toner, and the charging properties are stable, and thus, it is possible to obtain a high-definition image.

(Other Components)

The toner particles according to this embodiment may contain a charge control agent. In addition, the toner particles may contain components that are generally used in the toner base particles or the toner particles.

The charge control agent is not particularly limited insofar as the charge control agent is a substance that is capable of applying a positive charge or a negative charge by frictional charging and has no color, and various known charge control agents having positive charging properties and charge control agents having negative charging properties can be used.

The content of the charge control agent in the toner is preferably greater than or equal to 0.01 mass % and less than or equal to 30 mass %, and is more preferably greater than or equal to 0.1 mass % and less than or equal to 10 mass %.

Note that, the toner containing the binding resin may have a single-layer structure, or may be have a core-shell structure. The type of binding resin that is used in a core particle and a shell layer of the core-shell structure is not particularly limited.

(External Additive)

In order to improve the fluidity, the charging properties, the cleaning properties, or the like of the toner, an external additive a fluidizer that is a so-called post-treatment agent, a cleaning aid, and the like may be added to the surface of the toner base particles.

Examples of the external additive include inorganic particles such as inorganic oxide particles such as silica particles, hydrophobic silica particles (for example, hydrophobic sol-gel silica particles, hydrophobic fumed silica particles, and the like), alumina particles, titanium oxide particles, and hydrophobic titanium oxide (hydrophobic titania) particles, inorganic stearic acid compound particles such as aluminum stearate particles and zinc stearate particles, and inorganic titanic acid compound particles such as strontium titanate particles and zinc titanate particles. The size of the inorganic particles is preferably greater than or equal to 2 nm and less than or equal to 200 nm, and is more preferably greater than or equal to 7 nm and less than or equal to 150 nm, in an average particle diameter.

The inorganic particles can be independently used, or two or more types thereof can be used by being combined.

The inorganic particles may be subjected to surface modification by a silane coupling agent or a titanium coupling agent, a higher fatty acid, silicone oil, and the like, in order to improve heat-resistant preservability or environmental stability.

The content of the external additive in the toner is preferably greater than or equal to 0.05 mass % and less than or equal to 5 mass %, and is more preferably greater than or equal to 0.1 mass % and less than or equal to 3 mass %.

(Average Particle Diameter of Toner Particles)

An average particle diameter of the toner particles is preferably greater than or equal to 4 μm and less than or equal to 10 μm, and is more preferably greater than or equal to 4 μm and less than or equal to 7 μm, in a volume-based median size (D50). By setting the volume-based median size (D50) in the range described above, a transfer efficiency increases, halftone image quality is improved, and image quality of fine lines, dots, or the like is improved.

The volume-based median size (D50) of the toner particles is measured and calculated by using a measurement device in which a computer system provided with data processing software "Software V3.51" (manufactured by Beckman Coulter, Inc.) is connected to "Coulter Counter 3" (manufactured by Beckman Coulter, Inc.).

Specifically, 0.02 g of a measurement sample (a toner) is added to 20 mL of a surfactant solution (for example, a surfactant solution in which a neutral cleanser containing a surfactant component is diluted with pure water by 10 times, in order to disperse the toner particles), and mixed, and then, is subjected to ultrasonic dispersion for 1 minute, and thus, a toner particle dispersion liquid is prepared. The toner particle dispersion liquid is injected into a beaker in "ISOTONII" (manufactured by Beckman Coulter, Inc.) in a sample stand, with a pipette, until a display concentration of the measurement device is 8%.

Here, according to such a concentration range, it is possible to obtain a measurement value having reproducibility. Then, in the measurement device, the number of counts of measurement particles is 25000, an aperture diameter is 50 μm, a frequency value is calculated by dividing a range of 1 μm to 30 μm that is a measurement range into 256 ranges, and a particle diameter of 50% from a larger volume cumulative fraction is a volume-based median size (D50).

(Manufacturing Method of Toner)

A manufacturing method of the toner is not limited, and a known method may be used. For example, a suspension polymerization method, an emulsion association method, other known methods, and the like can be exemplified. Among them, it is preferable to use the emulsion association method. According to the emulsion association method, it is possible to easily decrease the diameter of the toner particles, from the viewpoint of a manufacturing cost and manufacturing stability.

In a manufacturing method of the toner base particles according to the emulsion association method, an aqueous dispersion liquid in which amorphous resin particles containing the first mold release agent and the second mold release agent as the mold release agent (for example, amorphous polyester resin particles) are dispersed in an aqueous medium, an aqueous dispersion liquid of the coloring agent particles, and as necessary, an aqueous dispersion liquid in which crystalline resin particles (for example, crystalline polyester resin particles) are dispersed are mixed. Next, shape control is performed by aggregating the amorphous resin particles, the coloring agent particles, and as necessary, the crystalline resin particles, and by performing association (fusion) between binding resin particles, and thus, the toner particles (the toner base particles) are formed.

Note that, an aqueous dispersion liquid of (a) or (b) described below may be used instead of the aqueous dispersion liquid in which the amorphous resin particles containing the first mold release agent and the second mold release agent are dispersed. That is, (a) an aqueous dispersion liquid in which the amorphous resin particles are dispersed and an aqueous dispersion liquid in which mold release agent particles containing the first mold release agent and the second mold release agent are dispersed may be used. Alternatively, (b) an aqueous dispersion liquid in which the amorphous resin particles containing any one of the first mold release agent and the second mold release agent are dispersed and an aqueous dispersion liquid in which the mold release agent particles containing the other of the first mold release agent and the second mold release agent are dispersed may be used.

An average particle diameter of the amorphous resin particles (oil droplets) or the crystalline resin particles (oil droplets) in the amorphous resin particle dispersion liquid or the crystalline resin particle dispersion liquid is preferably greater than or equal to 60 nm and less than or equal to 1000 nm, and is more preferably greater than or equal to 80 nm and less than or equal to 500 nm. Note that, the average particle diameter of the amorphous resin particles, the crystalline resin particles, the coloring agent particles, the mold release agent particles, and the like can be measured by a laser diffraction/scattering particle size distribution measurement device (a Microtrac particle size distribution measurement device "UPA-150" (manufactured by Nikkiso Co., Ltd.)). Note that, the average particle diameter of the resin particles (the oil droplets) can be controlled in accordance with the size of mechanical energy in emulsion dispersion.

Here, the aqueous dispersion liquid indicates a dispersion liquid in which dispersion elements (particles) are dispersed in an aqueous medium, and the aqueous medium indicates a medium in which a main component (greater than or equal to 50 mass %) is water. Examples of components other than water are capable of including an organic solvent soluble in water, and examples of the organic solvent include methanol, ethanol, isopropanol, butanol, acetone, methyl ethyl ketone, tetraydrofuran, ethyl acetate, and the like. Among them, an alcohol-based organic solvent that is an organic solvent in which a resin is not dissolved, such as methanol, ethanol, isopropanol, and butanol, is particularly preferable.

A dispersion stabilizer may be dissolved in the aqueous medium, and a surfactant, resin particles, or the like may be added in order to improve dispersion stability of the oil droplet.

Examples of the dispersion stabilizer are capable of including an inorganic compound such as tricalcium phosphate, carbonate calcium, colloidal silica, and hydroxy apatite. It is necessary to remove the dispersion stabilizer from the toner base particles to be obtained, and thus, it is preferable to use a dispersion stabilizer that is soluble in acid or alkali, such as tricalcium phosphate, or it is preferable to use a dispersion stabilizer that is decomposable by enzyme, from the viewpoint of the environment.

Examples of the surfactant include an anionic surfactant such as alkyl benzene sulfonate, α-olefin sulfonate, phosphoric acid ester, a sodium alkyl diphenyl ether disulfonic acid, and sodium polyoxyethylene lauryl ether sulfate, an amine salt type cationic surfactant such as an alkyl amine salt, an aminoalcohol fatty acid derivative, a polyamine fatty acid derivative, and imidazoline, a quaternary ammonium salt type cationic surfactant such as an alkyl trimethyl ammonium salt, a dialkyl dimethyl ammonium salt, an alkyl dimethyl benzyl ammonium salt, a pyridinium salt, an alkyl isoquinolinium salt, and benzethonium chloride, a non-ionic surfactant such as a fatty acid amide derivative and a polyhydric alcohol derivative, an ampholytic surfactant such as alanine, dodecyl di(aminoethyl) glycine, di(octyl aminoethyl) glycine, and N-alkyl-N,N-dimethyl ammonium betaine, and the like, and an anionic surfactant or a cationic surfactant having a fluoroalkyl group can also be used.

In addition, it is preferable that a particle diameter is greater than or equal to 0.5 μm and less than or equal to 3 μm, as the resin particles for improving the dispersion stability. Specifically, methyl polymethacrylic acid resin particles having a particle diameter of 1 μm and 3 μm, polystyrene resin particles having a particle diameter of 0.5 μm and 2 μm, polystyrene-acrylonitrile resin particles having a particle diameter of 1 μm, and the like are exemplified.

Emulsion dispersion of such an oil phase liquid can be performed by using mechanical energy. A disperser for performing the emulsion dispersion is not particularly limited. For example, a low-speed shearing disperser, a high-speed shearing disperser, a frictional disperser, a high-pressure jet disperser, an ultrasonic disperser such as an ultrasonic homogenizer, a high-pressure impact disperser, an ultimizer, and the like are exemplified.

When the amorphous resin particles, the coloring agent particles, and as necessary, the crystalline resin particles are aggregated, the obtained dispersion liquids are respectively mixed to be a mixed liquid, are heated at a temperature lower than or equal to a glass transition temperature of the amorphous resin, and are aggregated, and thus, aggregated particles are formed. The aggregated particles are formed by setting the pH of the mixed liquid to have acidity under stirring. The pH is preferably in a range of greater than or equal to 2 and less than or equal to 7, is more preferably in a range of greater than or equal to 2 and less than or equal to 6, and is even more preferably in a range of greater than or equal to 2 and less than or equal to 5. At this time, it is preferable to use an aggregating agent.

As the aggregating agent to be used, a surfactant having reverse polarity to a surfactant used in a dispersant, an inorganic metal salt, and a complex containing a divalent or higher metal can be preferably used.

Examples of the inorganic metal salt include a metal salt such as sodium chloride, potassium chloride, lithium chloride, calcium chloride, barium chloride, magnesium chloride, zinc chloride, aluminum chloride, copper sulfate, magnesium sulfate, aluminum sulfate, manganese sulfate, and calcium nitrate, an inorganic metal salt polymer such as polyaluminum chloride, polyaluminum hydroxide, polysilica iron, and calcium polysulfide, and the like. Among them, an aluminum salt and the polyaluminum chloride are particularly preferable. In order to obtain a sharper particle size distribution, a divalent inorganic metal salt is preferable to a monovalent inorganic metal salt, a trivalent inorganic metal salt is preferable to the divalent inorganic metal salt, and a tetravalent inorganic metal salt is preferable to the trivalent inorganic metal salt.

The amorphous vinyl resin particles may have a multi-layer structure of two or more layers formed of resins having different compositions, and examples of the amorphous resin particles having such a configuration include amorphous vinyl resin particles having a two-layer structure. The amorphous vinyl resin particles having a two-layer structure can be obtained by a method in which a dispersion liquid of resin particles is prepared by a polymerization treatment (first-stage polymerization) according to an ordinary method, a polymerization initiator and a polymerizable monomer are added to the dispersion liquid, and such a system is subjected to the polymerization treatment (second-stage polymerization).

(Developer)

A toner for developing an electrostatic charge image can also be used as a magnetic or non-magnetic one-component developer. In addition, the toner for developing an electrostatic charge image may be used as a two-component developer by being mixed with a carrier. In a case where the toner is used as the two-component developer, magnetic particles formed of a known material of the related art, for example, a metal such as iron, ferrite, and magnetite, and an alloy of such a metal and a metal such as aluminum and lead can be used as the carrier, and in particular, ferrite particles are preferable.

In addition, a coated carrier in which the surface of the magnetic particles is coated with a coating agent such as a resin, a dispersion type carrier in which a magnetic fine powder is dispersed in a binder resin, and the like may be used as the carrier.

A volume-based median size (a volume average particle diameter) (d50) of the carrier is preferably in a range of greater than or equal to 20 μm and less than or equal to 100 μm, and is more preferably in a range of greater than or equal to 25 μm and less than or equal to 80 μm.

The volume-based median size (the volume average particle diameter) (d50) of the carrier, representatively, can be measured by a laser diffraction type particle size distribution measurement device "HELOS" (manufactured by Sympatec GmbH) provided with a wet disperser.

In a case where a total mass of the toner and the carrier is 100 mass %, it is preferable that a mixed amount of the toner with respect to the carrier is in a range of greater than or equal to 2 mass % and less than or equal to 10 mass %.

As described above, the embodiment of the present invention has been described, but the present invention is not limited to the embodiment described above, and various change can be made.

Examples

The effects of the present invention will be described by using the following examples and comparative examples. However, the technical scope of the present invention is not limited to the following examples.

(Synthesis of Binding Resin 1)

50.7 parts by mass of a terephthalic acid, 5.1 parts by mass of a trimellitic acid, 33.8 parts by mass of a dodecanedioic acid, 135.1 parts by mass of a dodecenyl succinic anhydride, and 405.4 parts by mass of a bisphenol A propylene oxide (BPA-PO) 6 mol-adduct were put into a reaction vessel provided with a stirrer, a thermometer, a cooling pipe, and a nitrogen gas introduction pipe. The reaction vessel was substituted with dry nitrogen gas, and then, 0.1 part by mass of titanium tetrabutoxide was added, and a polymerization reaction was performed for 8 hours while performing stirring at 180° C. under a nitrogen gas airflow. Further, 0.2 part by mass of titanium tetrabutoxide was added, a temperature was increased to 220° C., and a polymerization reaction was performed for 6 hours while performing stirring, and then, the reaction vessel was depressurized to 10 mmHg, a reaction was performed under reduced pressure, and thus, a light yellow transparent amorphous polyester resin (referred to as a binding resin 1) was obtained as a binding resin. A glass transition temperature (Tg) according to a differential scanning calorimetryment device (DSC) was 49° C., and a weight average molecular weight (Mw) according to a gel permeation chromatography (GPC) was 28000.

(Preparation of Resin Dispersion Liquid 1)

200 parts by mass of the binding resin 1 was dissolved in 200 parts by mass of ethyl acetate, and then, was mixed with an aqueous solution in which sodium polyoxyethylene lauryl ether sulfate was dissolved in 800 parts by mass of ion exchange water such that a concentration was 1 mass %, and dispersion was performed by using an ultrasonic homogenizer. The ethyl acetate was removed from such a solution was under reduced pressure, and then, a resin dispersion liquid 1 was prepared. A solid content concentration of the resin dispersion liquid 1 (the content of resin particles 1) was adjusted to 20 mass %. An average particle diameter of the binding resin 1 in the resin dispersion liquid 1 (referred to as the resin particles 1) was 230 nm.

(Preparation of Cyan Coloring Agent Dispersion Liquid)

50 parts by mass of C.I. Pigment Blue 15:3 as a cyan coloring agent was put into a surfactant aqueous solution in which sodium alkyl diphenyl ether disulfonate was dissolved in 200 parts by mass of ion exchange water such that a concentration was 1 mass %, and then, dispersion was performed by using an ultrasonic homogenizer, and thus, a cyan coloring agent dispersion liquid was prepared. A solid content concentration in the cyan coloring agent dispersion liquid (the content of the cyan coloring agent) was adjusted to 20 mass %. An average particle diameter of the cyan coloring agent in the cyan coloring agent dispersion liquid was 150 nm.

(Preparation of Magenta Coloring Agent Dispersion Liquid)

50 parts by mass of C.I. Pigment Red 238 as a magenta coloring agent was put into a surfactant aqueous solution in which sodium alkyl diphenyl ether disulfonate was dissolved in 200 parts by mass of ion exchange water such that a concentration was 1 mass %, and then, dispersion was performed by using an ultrasonic homogenizer, and thus, a magenta coloring agent dispersion liquid was prepared. A solid content concentration in the magenta coloring agent dispersion liquid (the content of the magenta coloring agent) was adjusted to 20 mass %. An average particle diameter of the magenta coloring agent in the magenta coloring agent dispersion liquid was 150 nm.

(Preparation of Yellow Coloring Agent Dispersion Liquid)

50 parts by mass of C.I. Pigment Yellow 74 as a yellow coloring agent was put into a surfactant aqueous solution in which sodium alkyl diphenyl ether disulfonate was dissolved in 200 parts by mass of ion exchange water such that a concentration was 1 mass %, and then, dispersion was performed by using an ultrasonic homogenizer, and thus, a yellow coloring agent dispersion liquid was prepared. A solid content concentration in the yellow coloring agent dispersion liquid (the content of the yellow coloring agent) was adjusted to 20 mass %. An average particle diameter of the yellow coloring agent in the yellow coloring agent dispersion liquid was 153 nm.

(Preparation of Black Coloring Agent Dispersion Liquid)

50 parts by mass of carbon black (Product Name: "Mogul (Registered Trademark) L", manufactured by Cabot Corporation) as a black coloring agent was put into a surfactant aqueous solution in which sodium alkyl diphenyl ether disulfonate was dissolved in 200 parts by mass of ion exchange water such that a concentration was 1 mass %, and then, dispersion was performed by using an ultrasonic homogenizer, and thus, a black coloring agent dispersion liquid was prepared. A solid content concentration in the black coloring agent dispersion liquid (the content of the black coloring agent) was adjusted to 20 mass %. An average particle diameter of the black coloring agent in the black coloring agent dispersion liquid was 152 nm.

(Preparation of White Coloring Agent Dispersion Liquid)

210 parts by mass of rutile type titanium oxide (manufactured by ISHIHARA SANGYO KAISHA, LTD.) as a white coloring agent was put into a surfactant aqueous solution in which sodium alkyl diphenyl ether disulfonate was dissolved in 480 parts by mass of ion exchange water such that a concentration was 1 mass %, and then, dispersion was performed by using an ultrasonic homogenizer, and thus, a white coloring agent dispersion liquid was prepared. A solid content concentration in the white coloring agent dispersion liquid (the content of the white coloring agent) was adjusted to 30 mass %. An average particle diameter of the white coloring agent in the white coloring agent dispersion liquid was 200 nm.

(Preparation of Metallic Coloring Agent Dispersion Liquid)

210 parts by mass of an aluminum pigment (260EA, manufactured by Showa Aluminum Powder K.K., Average Particle Diameter of 10 μm) in which a solvent was removed from a paste, as a metallic coloring agent (pigment) was put into a surfactant aqueous solution in which sodium alkyl diphenyl ether disulfonate was dissolved in 480 parts by mass of ion exchange water such that a concentration was 1 mass %, and then, dispersion was performed by using an ultrasonic homogenizer, and thus, a metallic coloring agent dispersion liquid was prepared. A solid content concentration in the metallic coloring agent dispersion liquid (the content of the metallic coloring agent) was adjusted to 30 mass %. An average particle diameter of the metallic coloring agent in the metallic coloring agent dispersion liquid was 4 μm.

(Preparation of Mold Release Agent Dispersion Liquid)

180 parts by mass of a first mold release agent: behenyl behenate (Esprix (Registered Trademark) N-252, Melting Point of 73° C.) and 20 parts by mass of a second mold release agent: microcrystalline wax (HNP-0190, manufactured by NIPPON SEIRO CO., LTD.), as a mold release agent, were heated to 95° C. and were melted. Further, the mold release agent was put into a surfactant aqueous solution in which sodium alkyl diphenyl ether disulfonate was dissolved in 800 parts by mass of ion exchange water such that sodium alkyl diphenyl ether disulfonate was 3 mass %, and then, dispersion was performed by using an ultrasonic homogenizer, and thus, a mold release agent dispersion liquid was prepared. A solid content concentration in the mold release agent dispersion liquid (the content of the mold release agent) was adjusted to 20 mass %. An average particle diameter of the mold release agent in the mold release agent dispersion liquid was 190 nm.

(Synthesis of Color Toner)

875.2 parts by mass of the resin dispersion liquid 1, 166 parts by mass of the mold release agent dispersion liquid, 62 parts by mass of the cyan coloring agent dispersion liquid, and 0.5 part by mass of sodium polyoxyethylene lauryl ether sulfate were put into a reaction vessel provided with a stirrer, a cooling pipe, and a thermometer, and a hydrochloric acid of 0.1 N was added while performing stirring, and thus, pH was adjusted to 2.5. Next, 0.4 part by mass of a polyaluminum chloride aqueous solution (an aqueous solution of 10 mass % in terms of $AlCl_3$) was dropped for 10 minutes, and then, a temperature increase was performed at a speed of 0.05° C./min while performing stirring, and a particle diameter of aggregated particles was suitably measured by "Multisizer 3" (manufactured by Beckman Coulter, Inc.). In a case where a volume-based median size of the aggregated particles reached 5.6 μm, the temperature increase was stopped. After that, the pH of the system was set to 8.5 with a sodium hydroxide aqueous solution of 0.5 N, and particle diameter growth was stopped. Further, an internal temperature was increased to 85° C., and was cooled to a room temperature at a speed of 10° C./min at a time point when an average degree of circularity (a shape coefficient) was 0.960, by using "FPIA-2000" (manufactured by Sysmex Corporation), and a reaction liquid was repeatedly subjected to filtration and washing, and then, was dried, and thus, a cyan toner 1 that is one type of color toner was obtained.

The cyan toner 1 having an average particle diameter of 5.60 μm and an average degree of circularity of 0.965 was obtained as a cyan toner, by the method described above.

In addition, a magenta toner 1, a yellow toner 1, and a black toner 1 were prepared as with the (Synthesis of Color Toner) described above, except that the coloring agent dispersion liquid was changed.

(Synthesis of Cyan Toner 2)

A cyan toner 2 was prepared as with (Synthesis of Color Toner) described above, except that the added amount of the mold release agent dispersion liquid was changed to 635 parts by mass.

(Synthesis of Cyan Toner 3)

A cyan toner 3 was prepared as with (Synthesis of Color Toner) described above, except that the added amount of the mold release agent dispersion liquid was changed to 383 parts by mass (Synthesis of Cyan Toner 4)

A cyan toner 4 was prepared as with (Synthesis of Color Toner) described above, except that the added amount of the mold release agent dispersion liquid was changed to 49 parts by mass (Synthesis of Cyan Toner 5)

A cyan toner 5 was prepared as with (Synthesis of Color Toner) described above, except that the added amount of the mold release agent dispersion liquid was changed to 29 parts by mass (Synthesis of Cyan Toner 6)

A cyan toner 6 was prepared as with (Synthesis of Color Toner) described above, except that the amount of microcrystalline wax (HNP-0190) was set to 80 parts by mass and the amount of behenyl behenate was set to 160 parts by mass.

(Synthesis of Cyan Toner 7)

A cyan toner 7 was prepared as with (Synthesis of Color Toner) described above, except that the amount of microcrystalline wax (HNP-0190) was set to 58 parts by mass and the amount of behenyl behenate was set to 142 parts by mass.

(Synthesis of Cyan Toner 8)

A cyan toner 8 was prepared as with (Synthesis of Color Toner) described above, except that the amount of microcrystalline wax (HNP-0190) was set to 4 parts by mass and the amount of behenyl behenate was set to 196 parts by mass.

(Synthesis of Cyan Toner 9)

A cyan toner 9 was prepared as with (Synthesis of Color Toner) described above, except that the amount of microcrystalline wax (HNP-0190) was set to 2 parts by mass and the amount of behenyl behenate was set to 198 parts by mass.

(Synthesis of Cyan Toner 10)

A cyan toner 10 was prepared as with (Synthesis of Color Toner) described above, except that Hi-Mic 2095 (manufactured by NIPPON SEIRO CO., LTD.) was used instead of HNP-0190 (manufactured by NIPPON SEIRO CO., LTD.), as the second mold release agent: the microcrystalline wax.

(Synthesis of Cyan Toner 11)

A cyan toner 5 was prepared as with (Synthesis of Color Toner) described above, except that Hi-Mic 1045 (manufactured by NIPPON SEIRO CO., LTD.) was used instead of HNP-0190 (manufactured by NIPPON SEIRO CO., LTD.), as the second mold release agent: the microcrystalline wax.

(Synthesis of Cyan Toner 12)

A cyan toner 12 was prepared as with (Synthesis of Color Toner) described above, except that the amount of behenyl behenate was set to 200 parts by mass, and the microcrystalline wax (HNP-0190) was not used.

(Synthesis of Cyan Toner 13)

A cyan toner 13 was prepared as with (Synthesis of Color Toner) described above, except that the amount of microcrystalline wax (HNP-0190) was set to 200 parts by mass, and behenyl behenate was not used.

(Synthesis of Cyan Toner 14)

A cyan toner 14 was prepared as with (Synthesis of Color Toner) described above, except that 10 parts by mass of paraffin wax (HNP-9, manufactured by NIPPON SEIRO CO., LTD.) was used instead of the microcrystalline wax, and the amount of behenyl behenate was set to 190 parts by mass.

(Synthesis of Special color toner)

(Synthesis of Clear Toner)

A clear toner 1 was prepared as with (Synthesis of Color Toner) described above, except that the coloring agent dispersion liquid was not added.

(Synthesis of White Toner 1)

683.3 parts by mass of the resin dispersion liquid 1, 94.4 parts by mass of the mold release agent dispersion liquid, 222.2 parts by mass of the white coloring agent dispersion liquid, and 0.5 part by mass of sodium polyoxyethylene lauryl ether sulfate were put into a reaction vessel provided with a stirrer, a cooling pipe, and a thermometer, and a hydrochloric acid of 0.1 N was added while performing stirring, and thus, pH was adjusted to 2.5. Next, 0.4 part by mass of a polyaluminum chloride aqueous solution (an aqueous solution of 10 mass % in terms of $AlCl_3$) was dropped for 10 minutes, and then, a temperature increase was performed at a speed of 0.05° C./min while performing stirring, and a particle diameter of aggregated particles was suitably measured by "Multisizer 3" (manufactured by Beckman Coulter, Inc.). In a case where a volume-based median size of the aggregated particles reached 5.6 μm, the temperature increase was stopped. After that, the pH of the system was set to 8.5 with a sodium hydroxide aqueous solution of 0.5 N, and particle diameter growth was stopped. Further, an internal temperature was increased to 85° C., and was cooled to a room temperature at a speed of 10° C./min at a time point when an average degree of circularity (a shape coefficient) was 0.960, by using "FPIA-2000" (manufactured by Sysmex Corporation), and a reaction liquid was repeatedly subjected to filtration and washing, and then, was dried, and thus, a white toner 1 that is one type of special color toner was obtained. The content of titanium oxide that is the white coloring agent in the white toner 1 was 30 mass %

(Synthesis of White Toner 2)

A white toner 2 was prepared as with (Synthesis of White Toner 1) described above, except that the added amount of the white coloring agent dispersion liquid was changed to 5.8 parts by mass.

(Synthesis of White Toner 3)

A white toner 3 was prepared as with (Synthesis of White Toner 1) described above, except that the added amount of the white coloring agent dispersion liquid was changed to 623.5 parts by mass (Synthesis of Metallic Toner)

A metallic toner 1 was prepared as with (Synthesis of White Toner 1) described above, except that the blended amount of the resin dispersion liquid 1 and the coloring agent dispersion liquid was changed, "in a case where the volume-based median size of the aggregated particles reached 7.50 μm, the temperature increase was stopped", and "the internal temperature was increased to 85° C., and was cooled to a room temperature at a speed of 10° C./min at a time point when an average degree of circularity (a shape coefficient) was 0.950, by using "FPIA-2000" (manufactured by Sysmex Corporation)".

(Synthesis of Gray Toner 1)

683.3 parts by mass of the resin dispersion liquid 1, 94.4 parts by mass of the mold release agent dispersion liquid, 111.1 parts by mass of the black coloring agent dispersion liquid, and 0.5 part by mass of sodium polyoxyethylene lauryl ether sulfate were put into a reaction vessel provided with a stirrer, a cooling pipe, and a thermometer, and a hydrochloric acid of 0.1 N was added while performing stirring, and pH was adjusted to 2.5. Next, 0.4 part by mass of a polyaluminum chloride aqueous solution (an aqueous solution of 10 mass % in terms of $AlCl_3$) was dropped for 10 minutes, and then, a temperature increase was performed at a speed of 0.05° C./min while performing stirring, and a particle diameter of aggregated particles was suitably measured by "Multisizer 3" (manufactured by Beckman Coulter, Inc.). In a case where a volume-based median size of the aggregated particles reached 5.6 μm, the temperature increase was stopped. After that, the pH of the system was set to 8.5 with a sodium hydroxide aqueous solution of 0.5 N, and particle diameter growth was stopped. Further, an internal temperature was increased to 85° C., and was cooled to a room temperature at a speed of 10° C./min at a time point when an average degree of circularity (a shape coefficient) was 0.960, by using "FPIA-2000" (manufactured by Sysmex Corporation), and a reaction liquid was repeatedly subjected to filtration and washing, and then, was dried, and thus, a gray toner 1 that is one type of special color toner was obtained.

(External Addition Treatment of Toner)

1.5 parts by mass of sol-gel silica having an average particle diameter of 100 nm, which was hydrophobized with a hydrophobic treatment agent, 0.5 part by mass of fumed silica having an average particle diameter 20 nm, which was hydrophobized with a hydrophobic treatment agent, and 0.5 part by mass of titania having an average particle diameter 30 nm, which was hydrophobized with a hydrophobic treatment agent, with respect to 100 parts by mass of each of the obtained toners, were put into a mixer, and were mixed at a stirring speed of 25 m/s for 45 minutes, and thus, a toner to be evaluated (an evaluation toner) was prepared.

The obtained evaluation toner was used as a developer prepared in accordance with "Preparation of Developer" described below, and an evaluation toner set in which the developers were combined as shown in Table 2 described below was formed.

(Preparation of Developer)

A ferrite carrier having a volume average particle diameter of 35 μm, which was covered with an acryl-based resin was mixed with respect to each of the toners such that a toner concentration was 6 mass %, and thus, a developer was prepared. The amount of first mold release agent and second mold release agent in the toner of the upper layer, used in each of the examples and the comparative examples, a crystallization temperature of the toner of an upper layer, an attachment amount of the toner of an upper layer, an intermediate layer, and a lower layer, an attachment amount (a total attachment amount) of the toner on a recording medium, and the like are shown in Table 1. The attachment amount of the toner of the upper layer, the intermediate layer, and the lower layer in the evaluation toner set, and the like are shown in Table 2.

TABLE 1

| | Configuration of toner forming upper layer | | | | | | | Configuration of toner layer | | | | | |
|---|---|---|---|---|---|---|---|---|---|---|---|---|---|
| | | | | | | | | Upper layer | | Intermediate layer | | Lower layer | |
| | | Second mold release agent (microcrystalline wax) | | First mold release agent (ester wax) | | | | | | | | | |
| Lot | Total content of first mold release agent and second mold release agent in toner (mass %) | Type | Content (mass %) of second mold release agent in mold release agent | Type | Content of first mold release agent in mold release agent (mass %) | Crystallization temperature of toner; Tc (° C.) | Attachment amount of toner (total amount) on recording medium (g/m$^2$) | Toner type | Attachment amount of toner of upper layer with respect to attachment amount of toner (total amount) (mass %) | Toner type | Attachment amount of toner intermediate layer with respect to attachment amount of toner (total amount) (mass %) | Toner type | Attachment amount of toner of lower layer with respect to attachment amount of toner (total amount) (mass %) |
| Example 1 | 15 | HNP-0190 | 10 | Behenyl behenate | 90 | 65 | 25 | Cyan 1 | 10 | Yellow 1 | 10 | White 1 | 80 |
| Example 2 | 15 | HNP-0190 | 10 | Behenyl behenate | 90 | 65 | 39 | Cyan 1 | 10 | Yellow 1 | 10 | White 1 | 80 |
| Example 3 | 15 | HNP-0190 | 10 | Behenyl behenate | 90 | 65 | 9 | Cyan 1 | 10 | Yellow 1 | 10 | White 1 | 80 |
| Example 4 | 15 | HNP-0190 | 10 | Behenyl behenate | 90 | 65 | 25 | Clear 1 | 10 | Metallic 1 | 40 | White 1 | 50 |
| Example 5 | 15 | HNP-0190 | 10 | Behenyl behenate | 90 | 65 | 25 | Clear 1 | 10 | Metallic 1 | 40 | Gray 1 | 50 |
| Example 6 | 40 | HNP-0190 | 10 | Behenyl behenate | 90 | 65 | 25 | Cyan 2 | 10 | Yellow 1 | 10 | White 1 | 80 |
| Example 7 | 29 | HNP-0190 | 10 | Behenyl behenate | 90 | 65 | 25 | Cyan 3 | 10 | Yellow 1 | 10 | White 1 | 80 |
| Example 8 | 5 | HNP-0190 | 10 | Behenyl behenate | 90 | 64 | 25 | Cyan 4 | 10 | Yellow 1 | 10 | White 1 | 80 |
| Example 9 | 3 | HNP-0190 | 10 | Behenyl behenate | 90 | 63 | 25 | Cyan 5 | 10 | Yellow 1 | 10 | White 1 | 80 |
| Example 10 | 15 | HNP-0190 | 40 | Behenyl behenate | 60 | 63 | 25 | Cyan 6 | 10 | Yellow 1 | 10 | White 1 | 80 |
| Example 11 | 15 | HNP-0190 | 29 | Behenyl behenate | 71 | 63 | 25 | Cyan 7 | 10 | Yellow 1 | 10 | White 1 | 80 |
| Example 12 | 15 | HNP-0190 | 2 | Behenyl behenate | 98 | 63 | 25 | Cyan 8 | 10 | Yellow 1 | 10 | White 1 | 80 |
| Example 13 | 15 | HNP-0190 | 1 | Behenyl behenate | 99 | 63 | 25 | Cyan 9 | 10 | Yellow 1 | 10 | White 1 | 80 |
| Example 14 | 15 | Hi-Mic-2095 | 15 | Behenyl behenate | 85 | 82 | 25 | Cyan 10 | 10 | Yellow 1 | 10 | White 1 | 80 |
| Example 15 | 15 | Hi-Mic-1045 | 10 | Behenyl behenate | 90 | 52 | 25 | Cyan 11 | 10 | Yellow 1 | 10 | White 1 | 80 |
| Example 16 | 15 | HNP-0190 | 10 | Behenyl behenate | 90 | 63 | 25 | Cyan 1 | 92 | Yellow 1 | 4 | White 1 | 4 |
| Example 17 | 15 | HNP-0190 | 10 | Behenyl behenate | 90 | 63 | 25 | Cyan 1 | 5 | Yellow 1 | 15 | White 1 | 80 |
| Example 18 | 15 | HNP-0190 | 10 | Behenyl behenate | 90 | 63 | 25 | Cyan 1 | 10 | Yellow 1 | 10 | White 2 | 80 |
| Example 19 | 15 | HNP-0190 | 10 | Behenyl behenate | 90 | 63 | 25 | Cyan 1 | 10 | Yellow 1 | 10 | White 3 | 80 |

TABLE 1-continued

| | | Configuration of toner forming upper layer | | | | | | Configuration of toner layer | | | | | |
|---|---|---|---|---|---|---|---|---|---|---|---|---|---|
| | | | | | | | | Upper layer | | Intermediate layer | | Lower layer | |
| Lot | Total content of first mold release agent and second mold release agent in toner (mass %) | Second mold release agent (microcrystalline wax) Type | Second mold release agent (microcrystalline wax) Content (mass %) of second mold release agent in mold release agent | First mold release agent (ester wax) Type | First mold release agent (ester wax) Content of first mold release agent in mold release agent (mass %) | Crystallization temperature of toner; Tc (° C.) | Attachment amount of toner (total amount) on recording medium ($g/m^2$) | Toner type | Attachment amount of toner of upper layer with respect to attachment amount of toner (total amount) (mass %) | Toner type | Attachment amount of toner intermediate layer with respect to attachment amount of toner (total amount) (mass %) | Toner type | Attachment amount of toner of lower layer with respect to attachment amount of toner (total amount) (mass %) |
| Comparative Example 1 | 15 | HNP-0190 | 10 | Behenyl behenate | 90 | 65 | 50 | Cyan 1 | 10 | Yellow 1 | 10 | White 1 | 80 |
| Comparative Example 2 | 15 | HNP-0190 | 10 | Behenyl behenate | 90 | 65 | 6 | Cyan 1 | 10 | Yellow 1 | 10 | White 1 | 80 |
| Comparative Example 3 | 15 | HNP-0190 | 0 | Behenyl behenate | 100 | 65 | 25 | Cyan 12 | 10 | Yellow 1 | 10 | White 1 | 80 |
| Comparative Example 4 | 15 | HNP-0190 | 100 | Behenyl behenate | 0 | 65 | 25 | Cyan 13 | 10 | Yellow 1 | 10 | White 1 | 80 |
| Comparative Example 5 | 15 | HNP-9 | 10 | Behenyl behenate | 90 | 65 | 25 | Cyan 14 | 10 | Yellow 1 | 10 | White 1 | 80 |

TABLE 2

| | | Upper layer | | Intermediate layer | | Lower layer | |
|---|---|---|---|---|---|---|---|
| | | Toner type | Attachment amount of toner forming upper layer ($g/m^2$) | Toner type | Attachment amount of toner forming intermediate layer ($g/m^2$) | Toner type | Attachment amount of toner forming lower layer ($g/m^2$) |
| Example 1 | Developer 1 | Cyan toner 1 | 2.5 | Yellow toner 1 | 2.5 | White toner 1 | 20 |
| Example 2 | Developer 2 | Cyan toner 1 | 3.9 | Yellow toner 1 | 3.9 | White toner 1 | 31.2 |
| Example 3 | Developer 3 | Cyan toner 1 | 0.9 | Yellow toner 1 | 0.9 | White toner 1 | 7.2 |
| Example 4 | Developer 4 | Clear toner 1 | 2.5 | Metallic toner 1 | 10 | White toner 1 | 12.5 |
| Example 5 | Developer 5 | Clear toner 1 | 2.5 | Metallic toner 1 | 10 | Gray toner 1 | 12.5 |
| Example 6 | Developer 6 | Cyan toner 2 | 2.5 | Yellow toner 1 | 2.5 | White toner 1 | 20 |
| Example 7 | Developer 7 | Cyan toner 3 | 2.5 | Yellow toner 1 | 2.5 | White toner 1 | 20 |
| Example 8 | Developer 8 | Cyan toner 4 | 2.5 | Yellow toner 1 | 2.5 | White toner 1 | 20 |
| Example 9 | Developer 9 | Cyan toner 5 | 2.5 | Yellow toner 1 | 2.5 | White toner 1 | 20 |
| Example 10 | Developer 10 | Cyan toner 6 | 2.5 | Yellow toner 1 | 2.5 | White toner 1 | 20 |
| Example 11 | Developer 11 | Cyan toner 7 | 2.5 | Yellow toner 1 | 2.5 | White toner 1 | 20 |
| Example 12 | Developer 12 | Cyan toner 8 | 2.5 | Yellow toner 1 | 2.5 | White toner 1 | 20 |
| Example 13 | Developer 13 | Cyan toner 9 | 2.5 | Yellow toner 1 | 2.5 | White toner 1 | 20 |
| Example 14 | Developer 14 | Cyan toner 10 | 2.5 | Yellow toner 1 | 2.5 | White toner 1 | 20 |
| Example 15 | Developer 15 | Cyan toner 11 | 2.5 | Yellow toner 1 | 2.5 | White toner 1 | 20 |
| Example 16 | Developer 16 | Cyan toner 1 | 23 | Yellow toner 1 | 1 | White toner 1 | 1 |
| Example 17 | Developer 17 | Cyan toner 1 | 1.25 | Yellow toner 1 | 3.75 | White toner 1 | 20 |
| Example 18 | Developer 18 | Cyan toner 1 | 2.5 | Yellow toner 1 | 2.5 | White toner 2 | 20 |
| Example 19 | Developer 19 | Cyan toner 1 | 2.5 | Yellow toner 1 | 2.5 | White toner 3 | 20 |
| Comparative Example 1 | Developer 20 | Cyan toner 1 | 5 | Yellow toner 1 | 5 | White toner 1 | 40 |
| Comparative Example 2 | Developer 21 | Cyan toner 1 | 0.6 | Yellow toner 1 | 0.6 | White toner 1 | 4.8 |

TABLE 2-continued

| | | Upper layer | | Intermediate layer | | Lower layer | |
|---|---|---|---|---|---|---|---|
| | | Toner type | Attachment amount of toner forming upper layer ($g/m^2$) | Toner type | Attachment amount of toner forming intermediate layer ($g/m^2$) | Toner type | Attachment amount of toner forming lower layer ($g/m^2$) |
| Comparative Example 3 | Developer 22 | Cyan toner 12 | 2.5 | Yellow toner 1 | 2.5 | White toner 1 | 20 |
| Comparative Example 4 | Developer 23 | Cyan toner 13 | 2.5 | Yellow toner 1 | 2.5 | White toner 1 | 20 |
| Comparative Example 5 | Developer 24 | Cyan toner 14 | 2.5 | Yellow toner 1 | 2.5 | White toner 1 | 20 |

[Evaluation Method]

<Low-Temperature Fixing Properties: Under Offset>

In the evaluation of low-temperature fixing properties, first, each of the evaluation toner sets prepared as described above (the evaluation toners for an upper layer, an intermediate layer, and a lower layer in Table 1) were sequentially loaded in the image forming apparatus illustrated in FIG. 1 (however, a device fixing with a fixing belt was used as the fixing device; not illustrated). Next, in an environment of normal temperature and normal humidity (a temperature of 20° C. and relative humidity of 50% RH), an unfixed solid image was formed on 152 $g/m^2$ of Plike (manufactured by Nippon Paper Industries Co., Ltd.) such that the attachment amount of each of the upper layer, the intermediate layer, and the lower layer was as shown in Table 2 described above. Next, a surface temperature of the pressure roller of the fixing device was set to 140° C., and fixing was performed by changing a surface temperature of the heating roller by 2° C. in a range of higher than or equal to 140° C. and lower than or equal to 180° C. At this time, a fixing lower limit temperature of the fixing upper belt in which under offset did not occur was calculated. In addition, the calculation of the fixing lower limit temperature was performed with respect to both of toners having different storage conditions described above, the low-temperature fixing properties were evaluated in accordance with the following evaluation standards, and a case where the fixing lower limit temperature was lower than or equal to 151° C. (A and B) was considered as acceptable. Obtained evaluation results are shown in Table 3.

Evaluation Standards of Low-Temperature Fixing Properties

A: The fixing lower limit temperature is lower than or equal to 148° C.

B: The fixing lower limit temperature is higher than or equal to 149° C. and lower than or equal to 151° C.

C: The fixing lower limit temperature is higher than or equal to 152° C. and lower than or equal to 155° C.

D: The fixing lower limit temperature is higher than or equal to 156° C.

<Fixing Separation Properties>

The developers 1 to 24 in Table 2 described above were respectively loaded in a copying machine "bizhub PRO (Registered Trademark) C6501" (manufactured by Konica Minolta, Inc.) in which a fixing device was reconstructed such that a surface temperature of a heating roller for fixing could be changed in a range of higher than or equal to 100° C. and lower than or equal to 210° C. The surface temperature of the heating roller of the fixing device was set to 190° C., and in normal temperature and normal humidity (a temperature of 20° C. and relative humidity of 55% RH), a strip-shaped solid image having a width of 10 cm, which extended in an axial direction of the heating roller, was fixed onto A4-size recording paper "OK High-Quality Printing Paper (52.3 $g/m^2$) (manufactured by OJI PAPER CO., LTD.)" that was conveyed by longitudinal feeding, such that the attachment amount of each of the upper layer, the intermediate layer, and the lower layer was as shown in Table 2 described above, and the separation properties were evaluated in accordance with the following evaluation standards. A and B were considered as acceptable. Obtained evaluation results are shown in Table 3.

Evaluation Standards of Fixing Separation Properties

A: The recording paper can be separated from the heating roller without being curled, and there is no image degradation B: The recording paper is separated from the heating roller, but a white line is observed on the image C: The recording paper is wound around the heating roller, and thus, is not capable of being separated from the heating roller.

<Decrease in Image Concentration (Color Blur)>

(Image Forming Method and Evaluation Method for Color Blur Evaluation)

Five developing machines into which each of the developers (the evaluation toner sets) combined as shown in Tables 1 and 2 was put were put into a reconstructed machine (four types of units of YMCK were reconstructed to five types of units of YMCK+Special color toner, refer to FIG. 1) of "bizhub Pro (Registered Trademark) C6500" (manufactured by Konica Minolta, Inc.) that is an image forming apparatus. The reconstructed machine was used, a transparent OHP sheet was used, and an image was prepared in which an alphabet "A" (20 pt) of 5 cm×5 cm square was drawn on the OHP sheet, such that the attachment amount of each of the upper layer, the intermediate layer, and the lower layer was as shown in Table 2 described above. Whether or not the color of the color toner or the special color toner in the lower layer was capable of being recognized was observed with respect to the end portion of the image of "A" in each of one formed image and 10,000 formed images, visually and with an optical microscope (Keyence: VHX-2000) at a magnification of 2000 times. Note that, B and A are considered as acceptable. Obtained evaluation results are shown in Table 3.

Evaluation Standards of Decrease in Image Concentration (Color Blur)

A: The color blur is not capable of being recognized visually or with the optical microscope B: The color blur is not capable of being recognized visually, but the toner color of the lower layer can be recognized with the optical microscope C: The color blur can be slightly recognized visually, and the toner color of the lower layer can be clearly recognized with the optical microscope D: The color blur can be clearly recognized visually, and a dot failure is obvious even with the optical microscope.

TABLE 3

| | | Low-temperature fixing properties | | Fixing separation properties | Image concentration Decrease (color blur) |
|---|---|---|---|---|---|
| Example 1 | Developer 1 | A | 145° C. | A | A |
| Example 2 | Developer 2 | B | 151° C. | A | A |
| Example 3 | Developer 3 | A | 142° C. | A | B |
| Example 4 | Developer 4 | A | 147° C. | B | A |
| Example 5 | Developer 5 | A | 147° C. | B | A |
| Example 6 | Developer 6 | B | 151° C. | A | A |
| Example 7 | Developer 7 | B | 151° C. | A | A |
| Example 8 | Developer 8 | A | 143° C. | B | B |
| Example 9 | Developer 9 | A | 143° C. | B | B |
| Example 10 | Developer 10 | B | 151° C. | A | A |
| Example 11 | Developer 11 | B | 150° C. | A | A |
| Example 12 | Developer 12 | A | 146° C. | A | B |
| Example 13 | Developer 13 | A | 144° C. | A | B |
| Example 14 | Developer 14 | B | 151° C. | A | A |
| Example 15 | Developer 15 | A | 144° C. | A | B |
| Example 16 | Developer 16 | A | 147° C. | A | B |
| Example 17 | Developer 17 | B | 149° C. | B | B |
| Example 18 | Developer 18 | A | 143° C. | B | B |
| Example 19 | Developer 19 | B | 151° C. | A | A |
| Comparative Example 1 | Developer 20 | D | 159° C. | C | A |
| Comparative Example 2 | Developer 21 | A | 140° C. | A | D |
| Comparative Example 3 | Developer 22 | A | 142° C. | C | D |
| Comparative Example 4 | Developer 23 | D | 158° C. | C | A |
| Comparative Example 5 | Developer 24 | C | 155° C. | A | D |

From the results of Table 3, it was checked that in Examples 1 to 19 using the image forming method of the present invention, the low-temperature fixing properties and the fixing separation properties when the attachment amount increased were excellent, the oozing of the toner with respect to the layer adjacent to the upper layer image was prevented, and a decrease in the image concentration of the upper layer image was prevented, in the high-value added printing.

On the other hand, it was checked that in all of Comparative Examples 1 to 5, the image forming method of the present invention was not used, and thus, it was not possible to satisfy the low-temperature fixing properties, the fixing separation properties, and the prevention of a decrease in the image concentration (the color blur), in the high-value added printing.

As described above, the embodiment of the present invention has been described in detail, but the embodiment is descriptive and illustrative but not restrictive, and it is obvious that the scope of the present invention is to be construed by the appended claims. In addition, the present invention is not limited to the above description, and various changes can be made.

What is claimed is:

1. An image forming method, comprising:

transferring and fixing a toner onto a recording medium, and forming an image including a plurality of layers, wherein an attachment amount of the toner on the recording medium is greater than or equal to 8 g/m$^2$ and less than or equal to 40 g/m$^2$, a toner forming a layer in contact with a fixing member contains at least a first mold release agent containing ester wax and a second mold release agent containing microcrystalline wax, and a special color toner is contained in any layer of the plurality of layers.

2. The image forming method according to claim 1, wherein in the toner forming the layer in contact with the fixing member, a total content of the first mold release agent and the second mold release agent is greater than or equal to 5 mass % and less than or equal to 30 mass %, in a toner.

3. The image forming method according to claim 1, wherein in the toner forming the layer in contact with the fixing member, a content of the microcrystalline wax is greater than or equal to 2 mass % and less than or equal to 30 mass %, in a mold release agent.

4. The image forming method according to claim 1, wherein in the toner forming the layer in contact with the fixing member, a peak top temperature at a temperature decrease, as measured by a differential scanning calorimeter (DSC), is higher than or equal to 55° C. and lower than or equal to 80° C.

5. The image forming method according to claim 1, wherein an attachment amount of the toner forming the layer in contact with the fixing member is greater than or equal to 10 mass % and less than or equal to 90 mass %, with respect to a total attachment amount of the toner on the recording medium.

6. The image forming method according to claim 1, wherein the special color toner contains titanium oxide in an amount of greater than or equal to 2 mass % and less than or equal to 50 mass %, as a coloring agent.

7. The image forming method according to claim 1, wherein the layer containing the special color toner is different from the layer in contact with the fixing member.

* * * * *